US009289891B1

(12) United States Patent
Ragner

(10) Patent No.: US 9,289,891 B1
(45) Date of Patent: Mar. 22, 2016

(54) FOLDING MULTITOOLS

(71) Applicant: Gary Dean Ragner, Gainesville, FL (US)

(72) Inventor: Gary Dean Ragner, Gainesville, FL (US)

( * ) Notice: Subject to any disclaimer, the term of this patent is extended or adjusted under 35 U.S.C. 154(b) by 268 days.

(21) Appl. No.: 14/181,614

(22) Filed: Feb. 14, 2014

Related U.S. Application Data

(60) Provisional application No. 61/764,959, filed on Feb. 14, 2013.

(51) Int. Cl.
*B25F 1/04* (2006.01)
*B25F 1/00* (2006.01)

(52) U.S. Cl.
CPC . *B25F 1/04* (2013.01); *B25F 1/003* (2013.01); *B25F 1/006* (2013.01)

(58) Field of Classification Search
CPC ..... B25F 1/003; B25F 1/006; B25F 1/04; B25B 23/0028; B25B 13/481; B25B 13/56
See application file for complete search history.

(56) References Cited

U.S. PATENT DOCUMENTS

| | | | | |
|---|---|---|---|---|
| 415,923 | A * | 11/1889 | Painter | B25F 1/003 7/128 |
| 701,462 | A | 6/1902 | Bettman et al. | |
| 897,665 | A | 9/1908 | Rugg | |
| 1,186,807 | A | 6/1916 | Litomy | |
| 1,363,274 | A | 12/1920 | Saffold | |
| 1,369,829 | A | 3/1921 | Minges | |
| 2,097,361 | A | 10/1937 | Bagley | |
| 2,939,351 | A | 6/1960 | Falk | |
| 3,290,970 | A | 12/1966 | Lucia | |
| 3,572,190 | A | 3/1971 | Oeland | |
| 4,505,171 | A | 3/1985 | Chang | |
| D278,510 | S | 4/1985 | Schoeberlein | |
| 4,594,922 | A | 6/1986 | Park | |
| 4,694,711 | A | 9/1987 | Yang | |
| 4,838,132 | A | 6/1989 | Pyles | |
| D303,916 | S | 10/1989 | Colvin | |
| 5,136,902 | A | 8/1992 | Ma | |
| 5,267,366 | A * | 12/1993 | Frazer | B25F 1/04 7/128 |
| 5,313,860 | A | 5/1994 | Liou | |
| 6,079,301 | A | 6/2000 | Scolo | |
| 6,131,492 | A | 10/2000 | Mai | |

(Continued)

OTHER PUBLICATIONS

U.S. Non-Provisional Patent Applications PCT/US13/55208, titled "Folding Multiwrenches" filed on Aug. 15, 2013 by the same inventor discloses various tool designs that are related to the present Application and should be reviewed along with its related U.S. Appl. No. 61/683,345, filed Aug. 15, 2012 under the same title in its entirely as prior art.

*Primary Examiner* — David B Thomas

(57) ABSTRACT

A folding multitool for holding a plurality of diverse tools, comprising at least three tool arms, where at least two tool arms are pivotally attached to a central hub at one end, and each tool arm having at least one tool head attached at the other end. Wherein the tool arms fold to a smaller stowed position and unfold to an extended longer operational position. Wherein each tool arm can be used either as a tool handle or as a tool arm depending on the positions of the tool arms, and which end of the extended multitool the user grasps. During use, the rotational axes of a gripping surfaces on one or more wrench heads can be oriented substantially perpendicular to the hinge axis of its respective tool arm, whereby torque can be transmitted across the hinge axes for turning the plurality of different sized rotary fastener without the need for hinge locking mechanisms.

18 Claims, 10 Drawing Sheets

(56) References Cited

U.S. PATENT DOCUMENTS

Figure 1B:
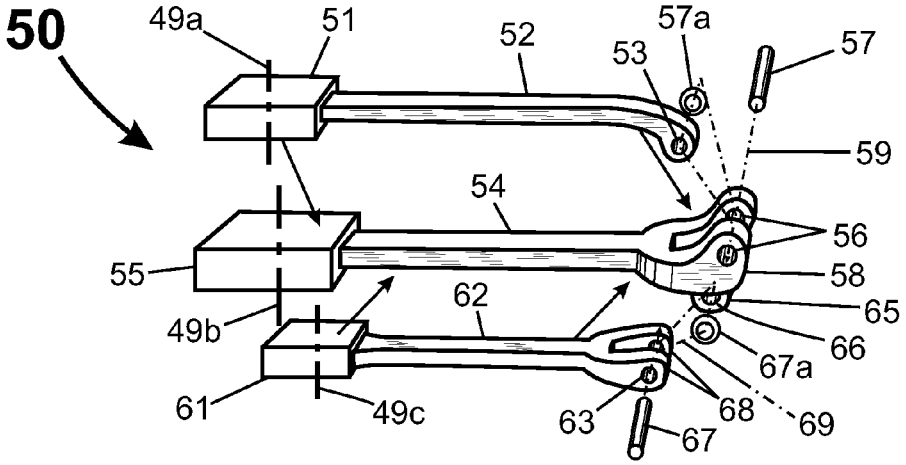
Figure 1B:
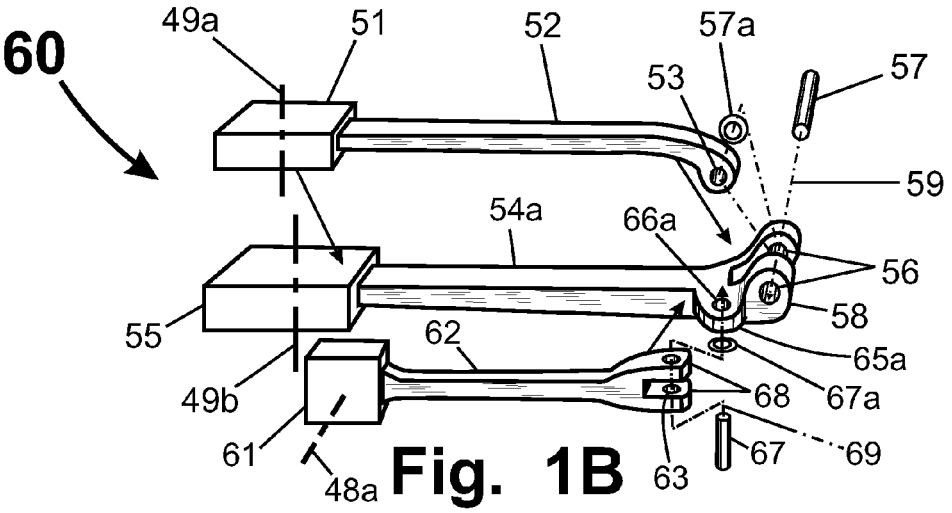

| | | | | |
|---|---|---|---|---|
| 6,219,870 | B1 * | 4/2001 | Swinden | B25F 1/003 7/118 |
| 6,311,586 | B1 | 11/2001 | Hirse | |
| 6,662,688 | B1 | 12/2003 | Avery | |
| 7,467,574 | B1 * | 12/2008 | Lin | B25B 13/461 81/177.85 |
| 7,712,397 | B2 * | 5/2010 | Hu | B25B 13/481 81/125.1 |
| 7,926,393 | B2 | 4/2011 | Hart | |
| 8,161,847 | B1 | 4/2012 | Considine | |
| 8,875,601 | B2 * | 11/2014 | Johnson | B25B 15/008 7/168 |
| 9,089,960 | B2 * | 7/2015 | Wang | B25F 1/04 81/440 |
| 2003/0178863 | A1 * | 9/2003 | Webster | B25B 13/02 294/2 |
| 2010/0088826 | A1 * | 4/2010 | Chen | B25F 1/04 7/138 |
| 2011/0005357 | A1 * | 1/2011 | Chen | B25B 13/04 81/125.1 |

* cited by examiner

Fig. 1A - Prior Art

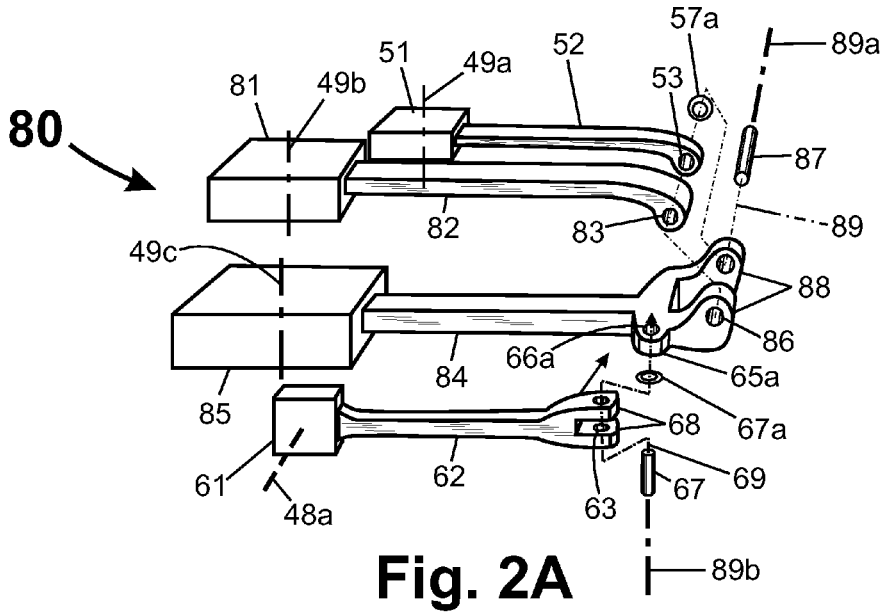
Fig. 2A
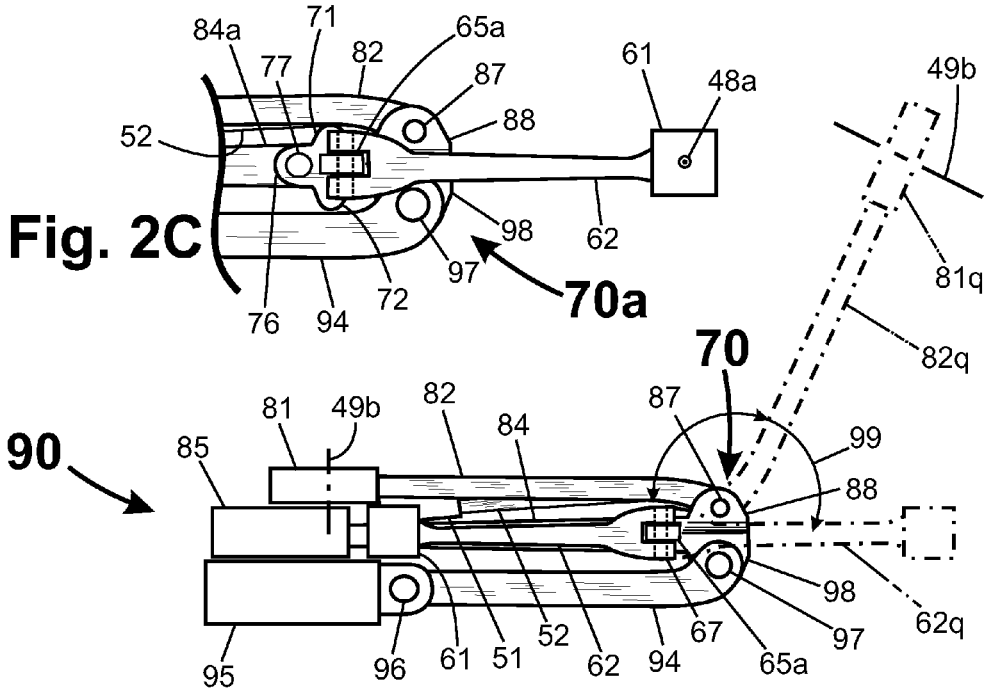
Fig. 2C
Fig. 2B

FOLDING MULTITOOLS

CROSS REFERENCE TO RELATED APPLICATIONS

This is a non-provisional of, and claims the benefit of, U.S. Provisional Patent Application 61/764,959, titled "FOLDING MULTITOOLS" filed on Feb. 14, 2013 by the same inventor, the disclosure of which is hereby incorporated by reference in its entirety.

FIELD

The field of this invention relates to hand tools for various purposes and comprises at least three tool heads pivotally connected to one another, and more specifically comprising two or more folding hinges where at least one folding hinge axis is not substantially parallel to one of the other folding hinge axes which allows the tools to be folded to a compact stowed position for carrying.

BACKGROUND OF INVENTION

The present state of the art for hand tools is very diverse. For wrenches, they normally come in sets of six or more wrench sizes. These sets usually come in a holding case or other holding structure to keep the tools together. Wrench sets allow the user to tighten and loosen rotary fasteners (bolts, screws, nuts, specialty fasteners, and etc.). The disclosed multitools besides having wrench tools can incorporate many other types of hand tools, such as, pry bars, cutting tools, hammers, screwdrivers, pliers, knives, saws, scissors, etc. Most American homes have at least one wrench set in their home, and usually have at least one hammer and screwdriver. Because of the universal nature of wrenches, each example presented in this patent includes a full set of wrenches or sockets. However, other tools can be substituted for the wrenches if desired. Prior art wrenches include a multitude of ways of providing torque to various rotary fasteners, and can include a ratchet mechanism that can be bidirectional (selectively reversible) or unidirectional (ratchet action only in one direction). The tools that can be used with the disclosed folding multitool system can be very diverse and can comprise nearly any hand tool.

Because of the number of wrench sizes that are available, it is advantageous to use low-profile wrench heads which can allow the wrenches to fold together in a compact stowed position. However, very low-profile wrench heads which can comprise stamped sheet metal, makes the wrenches very hard to use, but can be folded to a very compact state. The disclosed multitool is preferably intended for use with common wrench head types such as, box-end wrench heads, open-end wrench heads, flare nut wrench heads, low profile adjustable wrenches (i.e. crescent style, and other low-profile adjustable wrenches), dual wrench heads (back-to-back wrench gripping surfaces), quad wrench heads, low-profile socket style wrenches, specific-size torque wrenches, spanner head wrenches, logger head wrenches, and other low-profile wrenches. The invention is also useful for medium-profile wrenches, such as, plumbers style wrenches (pipe wrench), dog bone wrench heads, and other medium-profile and specialty wrenches. Many of these wrench types can also include a low profile ratchet mechanism, if desired. Wrenches like dog bone wrenches (ready wrench), plumbers' wrenches, and other thicker wrenches are on the upper end for wrench thickness that still allow convenient folding of the wrenches into a compact state after use. Along with the multiple wrenches, this invention can also comprise other low-profile to medium-profile tools, such as, but not limited to, hammers, screwdrivers, pry bars, scraping tools, box cutters, knives, saws, ratchet drivers (for sockets), files (wood and/or metal), pliers, axes, and other hand tools. Thicker tools and/or longer tools can fold as needed to form a compact stowed position (see screwdriver 155 in FIGS. 7A-B in relation to wrench head 126*e* and plier claw portions 162 and 163). Wrench and socket heads themselves can have a pivot hinge pin or knobs (see swivel hinge pin 144 in FIG. 4C, swivel hinge pin 154*e* in FIG. 5A, pivot knobs 173*r* in FIG. 7A, pivot hinge 165 in FIG. 7B, and the many socket hinges in FIGS. 9A and 10) and can be designed to pivot to multiple positions for use and then can pivot back to a low-profile position for stowage.

The use of the term "wrenches" is often used in this patent to differentiate them from wrench sockets or socket wrench designs which, during use, have a higher profile above a rotary fastener than a common wrench. One way to provide a compact socket set is to make the socket substantially parallel to the tool arm (see socket 181 and arm 182 in FIG. 9A) and simply have a large number of tool arms. However, the use of standard sockets can hinder compact storage of a full socket set because of the large number of sockets and arms that must be used. In the past, only single socket sizes were taught for each arm as seen in U.S. Pat. No. 4,505,171 to Chang. In Chang's design, the number of socket sizes is limited to four because only four arms are available for tools. In the disclosed multitool designs, eight or more tool arms are possible (see FIGS. 5A-B, and 7A) and thus eight or more single sized sockets similar to Chang's can be used. However, this patent also teaches using double sided pivotal sockets which allow the total number of sockets to be twice the number of tool arms. Thus, a full set of sockets in both metric and standard can be combined in a single multitool with the disclosed invention. Chang's design only shows four sizes since these four sizes cover the common automotive lug nuts sizes (additional sizes not needed for this purpose), thus there was no reason for him to develop a way to add more socket sizes. Along with, or in-place of the wrench and socket type tools just discussed, other tools can be attached and used (see adjustable wrench head 126*c*, pivotal ratchet wrench head 140, hammer 150, screwdriver 155, and pliers 160).

The wrench heads disclosed in this patent can use all three of the basic styles of wrenches: 1) single direction ratchets, 2) reversible ratchets, or 3) no ratchet mechanism at all. These three styles of wrenches are compatible with the presented folding multitool (multiwrench) invention in various combinations. Each of these wrench styles can use one or more wrench head types, such as, 1) box-end head, 2, flare nut head, 3) open-end head, 4) spanner head, 5) bung head, 6) dog bone style rotary head (Ready Wrench®), 7) duplex head (two sizes facing in opposite directions) (U.S. Pat. No. D278,510), 8) overlapped heads (U.S. Pat. Nos. 5,313,860; 6,131,492), 9) overlapped duplexed heads (4-sizes) (U.S. Pat. No. 7,926,393), 10) rotary dial head (U.S. Pat. No. 4,694,711), 11) multi-size ends (box and open), 12) adjustable box-ends (variable size opening) (U.S. Pat. Nos. D303,916; 4,838,132), 13) adjustable open-ends (Crescent®, plumbers, etc.), 14) self-clamping (U.S. Pat. Nos. 701,462; 897,665; 1,363,274; 3,290,970; 3,572,190; 4,594,922; 6,311,586), 15) adjustable logger head (Bionic Wrench®), 16) Channel-lock® style pliers, and 17) other specialty wrenches and wrench heads. This list of wrench head types is not exhaustive, but gives the reader a good idea of the types of wrench heads that are appropriate for use with the disclosed folding multitool. Each of these wrench head types should be considered possible candidates for each tool head discussed in this patent. The wrench head types 6) through 17) can be considered multi-sized wrench heads and are the type of wrench head designs preferable for used with the disclosed folding multitool. Wrench types 1) through 5) can still be used with the disclosed multitool for some of the wrenches, but using multi-sized wrench heads will reduce the number of wrench arms and wrench heads needed for a particular wrench set, or tool set, and thus can make the folding multitool more ergonomic.

These wrench head styles and types can each come with a variety of wrench gripping surfaces for use with different types of fasteners. The wrench gripping surfaces commonly used today comprise: 1) four-point standard (square shape), 2) six-point standard (hexagon shape), 3) twelve-point standard (double hexagon), 4) twelve-point spline, 5) lobed gripping surfaces (both six and twelve point), 6) saw toothed surfaces, 7) asymmetric gripping surfaces, 8) variations on these basic gripping surfaces, and 9) many other shape specialty shapes for various purposes. This list of gripping surfaces is not exhaustive and many other gripping surface designs exist in the patent record that can be used with the disclosed folding wrench system.

The disclosed folding multitools can define two or more hinges that fold the attached tools into a compact pocket-ready stowed position along more than one hinge axis direction when not in use. Besides the folding hinges that fold the multitool into a stowed position, each tool head can comprise a pivotal hinge near the tool head so that the tool head can be angled with respect to its arm. If the tool head is a wrench head, this means it can be angled to turn a rotary fastener (bolts, screws, nuts, and etc.) at various angles. The distance between a particular wrench's pivotal hinge and the wrench head itself is normally made small so that the wrench head can fit into tight spaces. Both the folding hinge(s) and the tool head pivotal hinges can include a stabilizing means that provide sufficient friction and/or a locking action in the hinge joint so that the multitool can hold a particular angle during use. The stabilizing means can comprise standard friction devices common to wrenches to provide a smooth controlled friction system (see FIGS. 1A-B) and/or multiple stable position devices and locking devices that are common to the wrench industry (see FIG. 4C). The term "folding hinge" is used within this patent to identify a hinge that is used to fold and extend the multitool's arms, as opposed to other hinges like wrench head swivel hinge pin 154*e* which is used to pivot wrench head 154 for use. Because of the similarity between the definitions of the words "pivoting" and "folding", the terms "pivoting" and "pivotal" will sometimes be used when discussing "folding hinges" and the term "folding" at times used when discussing pivotal tool head hinges.

All hinges can comprise a friction means and/or locking mechanism to help hold the tool arms and/or tool heads at a particular angle with respect to the rest of the multitool. These friction and locking means can comprise any standard system used with hinges to help hold a tool arm in place during use. A few examples of friction creating and locking systems are shown in this patent, and many others can be used.

The disclosed invention can comprise a full set of wrench sizes combined into a single tool, that can significantly reduce the overall stowed size of the multitool. Other types of hand tools may also be incorporated into the multitool. In the disclosed designs, the tool arms can fold from different directions around a center handle to provide stability to the entire multitool. In many cases, this means the multitool arms are approximately half the length of the multitool when extended (see FIGS. 3A-B). In some configurations the tool arms can have different lengths to allow the wrench heads to store adjacent, and/or nest next to each other along the length of the arms (see FIGS. 3A-B, 4A and 4C) instead of on top of the other wrench heads (see heads 81, 85, and 95 in FIG. 2B). Similarly, this folding multitool design can pivot the tool arms to the side with a folding hinge axis that is more than twenty degrees from parallel (not substantially parallel) with at least one other folding hinge axis. This allows more tool arms to be attached around the central hub for a larger number of tool heads (see the disclosed eight tool head multitools in FIGS. 5A through 7). In the shown examples, the disclosed multitools can provide two or more folding hinges on a central hub. The central hub can also support a central tool arm securely affixed to the central hub on one end of the tool arm and a center tool on the other end. This securely fixed center arm can transfer pivotal torque to the central hub in any direction, and thus apply pivotal torque to any particular folding hinge to transfer torque to a particular tool for useful work. Similarly, because the center arm is fixed to the central hub, torque can be transferred from the pivotal arm to the central hub in specific directions. Each hinge may include a friction mechanism and/or a locking mechanism to stabilize and/or hold the arms in a particular configuration during use. The prior art shows many friction and locking mechanisms that are commonly used with wrenches, ratchets, and other hand tools similar to the disclosed folding multitool. Both friction and locking mechanism examples are shown in this patent, but these example designs are only a small sampling of the many types of motion stabilizing mechanisms (friction, locking, etc.) for hinges and pivots that are presently designed for hand tools. Nearly all prior art hinge stabilizing mechanisms designed for hand tools can be easily made to work on the disclosed folding multitool.

Most combination of tool heads, wrench styles, wrench types and wrench gripping surfaces can be used to make various folding multi-tool sets using the disclosed technology. Also, for wrenches, different combinations of wrench styles and/or types can be combined into a single multitool if desired. For example, a crescent type wrench can be combined with both box ends and/or open end wrench sets (see FIG. 5A) to provide a highly functional multitool. Similarly, other tools can be combined with the wrench sets to provide a very versatile multitool (see FIGS. 6A-B, and 7A-B).

PRIOR ART

Many designs exist in the prior art that provide multiple wrench sizes and other tools in a single multitool, however none were found that place the gripping axes of multi-sized wrench heads substantially perpendicular to the folding hinge axes of the multitool except the multiwrench design disclosed by the Applicant in U.S. Provisional Application Ser. No. 61/683,345 filed on Aug. 15, 2012. The herein disclosed multitools further comprise one or more wrenches with folding hinges that have pivotal axes that are not substantially parallel to the other folding hinge axes.

U.S. Pat. No. 6,662,688 to Avery, show a folding lug wrench which includes a first arem connected to a mounting member, two foldable arms connected to the first arm and a fourth detachable arm capable of attaching to the mounting member in the first position. All lug nut sockets have gripping surface axes that are parallel with the longitudinal direction of their respective arm.

U.S. Pat. No. 4,505,171 to Chang, shows a foldable cross wrench that has four wrench members (arms) pivoted to a coupling member (hinge hub) and unfolded to a cross shape or folded together for a stowed configuration. Only gripping surface axes that are parallel to their respective wrench arms are taught by Chang, and no center tool is shown attached securely to the mounting member (central hub).

U.S. Pat. No. 2,939,351 to Falk shows a folding lug nut wrench (folding cross wrench) with four socket sizes, three of which have foldable tool arms. This allows the four arms to be folded longitudinally adjacent to each other for stowage. The sockets are permanently fixed parallel to the longitudinal axis of their respective tool arm. Falk does not appear to disclose a way to make his wrenches small enough to fit easily in one's pocket (pocket ready). Also, this wrench is specifically designed to be used in a double handle configuration because of its intended use, thus no provision is provided for using the tools in a long handle position (unfolded arms used as an extended handle. Chang teaches using parallel folding hinge axes to fold his collapsible lug wrench to a stowed position. Arm 14 appears fixed to center hub 12.

U.S. Pat. No. 1,369,829 to Minges shows a folding wrench with a plurality of tool arms with three arms shown pivotal around a single folding axis and able to fold together for stowage. The folding axis is parallel with the rotational axis of each gripping surface. The folding tool arms 16 cannot pivot to a fully extended length because of the walls of slot 6 and instead stops at an awkward angle when in use.

SUMMARY

The disclosed Folding Multitool Sets can combine a full set of tools, including wrenches into a single compact tool or multitool. The invention has five unique features that can define it over the prior art. First, at least one of the folding tools can be a multi-wrench that provides more than one wrench size, either by providing multiple fixed sizes or by being an adjustable wrench. Second, each of the folding tools can be used as a tool or as an extended handle depending on the configuration of the multitool. Third, at least one folding tool hinge has a pivot axis orientation that is greater than twenty degrees from parallel with the pivotal axis of another wrench hinge, whereby the maximum number of folding wrenches that can be folded around a multitool can be increased (not all wrench hinges are parallel). Forth, the rotary axis of each wrench head gripping surface can be oriented substantially perpendicular to the folding hinge axis for that folding wrench (wrench arm pivot axis) to allow torque to be transferred to the wrench head gripping surface without needing a locking mechanism on the wrenches folding hinge. Fifth, one central tool arm can be securely affixed to a central hub and cannot pivot with respect to the central hub, whereby torque can be transferred from this one affixed center tool arm to any of the other folding wrenches for turning rotary fasteners without a need for a locking mechanism for the folding hinges. Notice in this fifth feature that the affixed center tool arm may still rotate axially along the center arm's longitudinal axis if desired (e.g. a ratcheting screwdriver) and still provide a non-pivoting attachment to the central hub.

The disclosed multitools, when extended, can place the wrench hinges near the middle of the extended wrench to allow the wrench to fold roughly in half for a more compact stowed position for the multitool. The multitool can have one or more stowed configurations and can have a multitude of extended configurations. The exact number of stowed and extended configurations can depend on the number of separate wrenches used, the number of hinge joints, the range of motion of these hinge joints, and arrangement of the hinge joints on the multitool. For ergonomic operation of wrench tools in a long handle mode, the arm(s) that are rotated away for use as a handle should be substantially parallel with the tool arm being used as a wrench tool. If the arms being used as a handle are not substantially parallel to the arm being used with the tool head, torques are more difficult to transfer to the rotary fastener without the wrench becoming unstable.

Present technology allows wrench head to provide more than one distinct wrench size, or be adjustable to many sizes as is seen in the prior art and/or variations on the prior art. Each folding multitool set has a stowed position where the tools can be significantly reduced in size compared to when the tools are extended for use. The disclosed multitools can comprise many non-wrench hand tools, such as, a hammer, a knife, a pliers, a screwdriver, a pry bar, a chisel, a ratchet head, etc. In fact, the disclosed multitool can be designed to not have any wrenches at all.

Objectives and Advantages

Figure 6A:
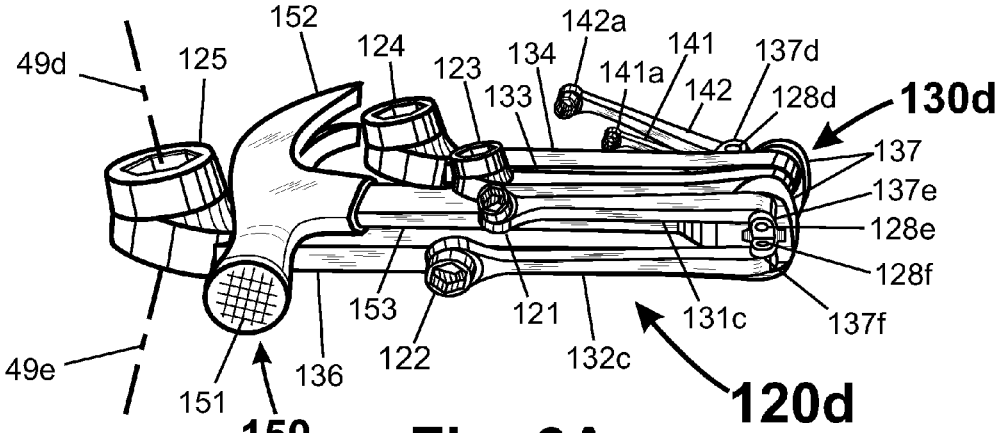
Figure 7A:
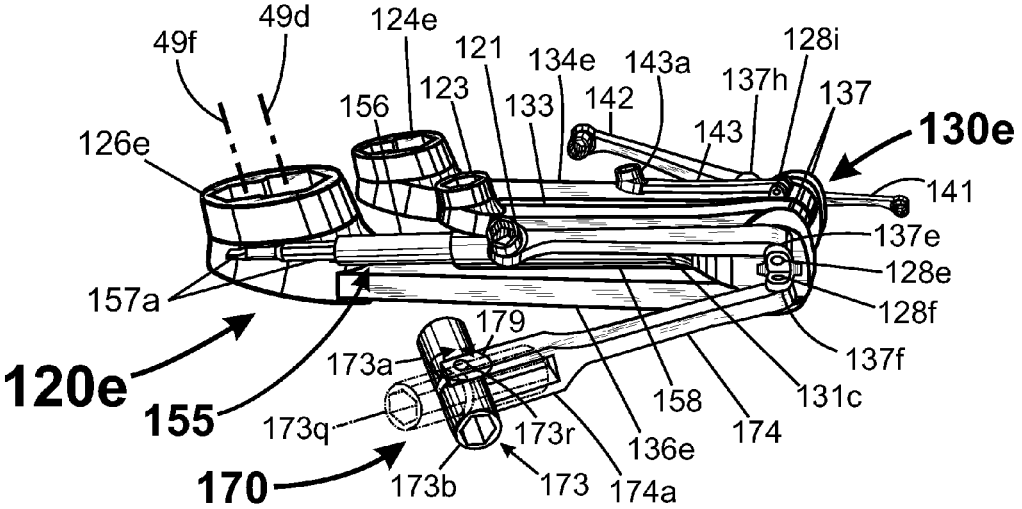
Figure 10:
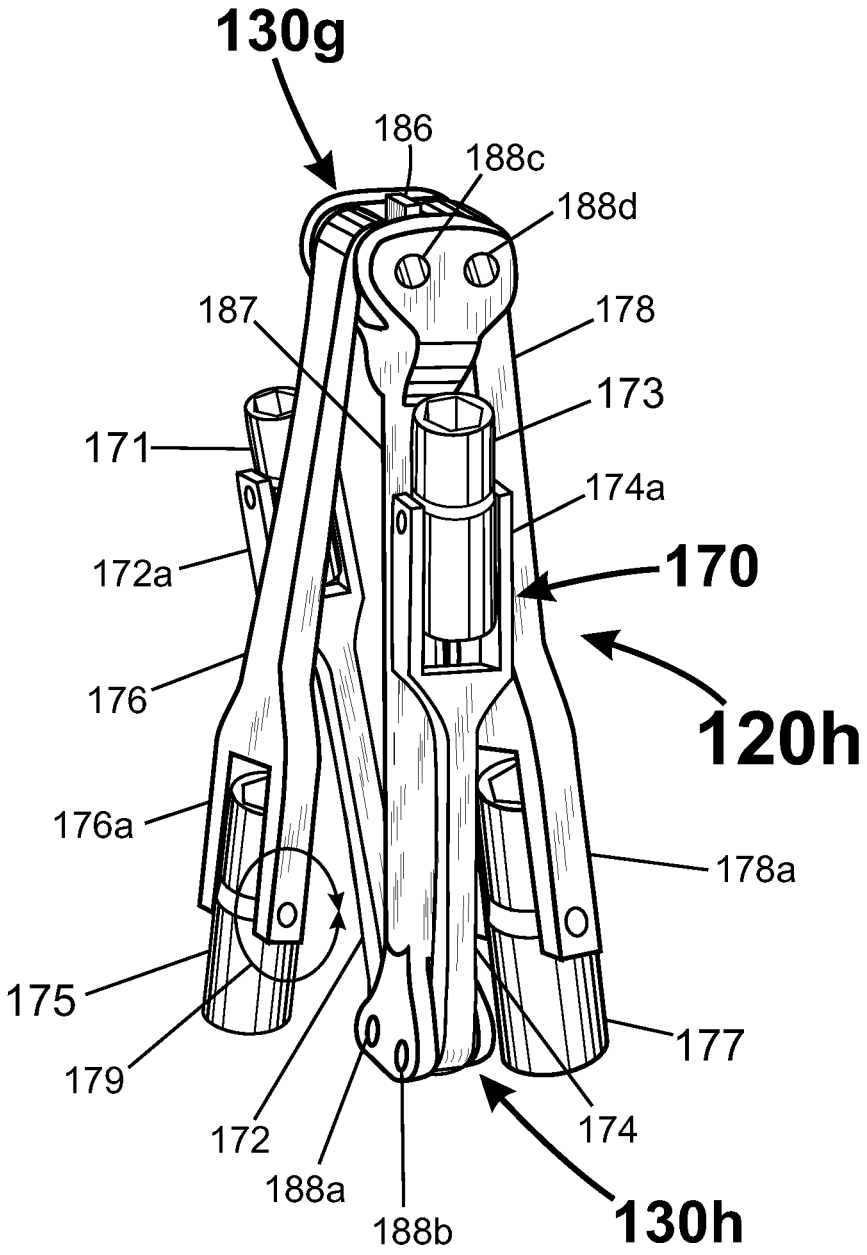

Accordingly, many unique structures and advantages of my invention are:

a) To provide a multitool that can fold to less than seventy percent (<70%) of its fully extended length when not being used.

b) To provide a multitool that can fold to less than sixty-five percent (<65%) of its fully extended length when not being used.

c) To provide a multitool that can fold to less than sixty percent (<60%) of its fully extended length when not being used.

d) To provide a multitool that can fold to less than fifty-five percent (<55%) of its fully extended length when not being used.

e) To provide a multitool that can fold to less than fifty percent (<50%) of its fully extended length when not being used (tri-fold multitools, see FIG. 10).

f) To provide a multitool that can fold to less than forty-five percent (<45%) of its fully extended length when not being used (tri-fold multitools, see FIG. 10).

g) To provide a multitool that can fold to less than forty percent (<40%) of its fully extended length when not being used (tri-fold multitools, see FIG. 10).

h) To provide a multitool that provides multiple tools that are permanently attached to the multitool so that the tools cannot be separated from the multitool set during use.

i) To provide a multitool that provides multiple wrenches that are permanently attached to the wrench so that the wrenches cannot be separated from the wrench set during use.

j) To provide a multitool where two or more tools are pivotally attached to a center tool, wherein each tool can be pivoted for use in an extended position while the other tools can be used as an extended handle for the tool being used.

k) To provide a multitool where two or more tools are pivotally attached to a center tool, wherein each tool can be pivoted for use while the other tools can be used as a handle without the hinges being locked in place (i.e., pivot axis is substantially perpendicular to the torque applied to use tool).

l) To provide a multitool where two or more tools are pivotally attached to a center tool, wherein each tool can be pivoted for use while the other tools can be used as a handle.

Wherein one or more pivotally attached tools have a hinges that can be selectively locked in place with a locking mechanism.

m) To provide a multitool where three, four, five, or more tools are pivotally attached to a central hub, wherein at least one tool has a folding hinge with a pivotal axis that is not substantially parallel to one of the other tool's pivotal axis.

n) To provide a multitool where three or more tools are pivotally attached to a central hub, wherein a center tool is securely attached to the center hub, wherein each wrench tool has a folding hinge with a pivotal axis is angled with respect to the wrenches so that torque can be transferred from one wrench to the another during use without the need for a locking mechanism on the pivotal axis to prevent pivoting of the wrenches with respect to each other during use.

o) To provide a multitool where three or more wrench tools are pivotally attached to a central hub, wherein a center tool is securely attached to the center hub. Wherein at least one wrench tool has a folding hinge with a pivotal axis is angled with respect to the wrenches so that torque can be transferred from one wrench to the another during use without the need for a locking mechanism on the pivotal axis to prevent pivoting of the wrenches with respect to each other during use.

p) To provide a multitool where on a central housing (central hub) at least two hinge axes are not parallel to one another. Wherein one or more tool arms are pivotally attached to each hinge, and where the tool arms are pivotal through approximately one-hundred eighty degrees or more with respect to the central housing (central hub).

q) To provide a multitool set where two hinge axes are not parallel to one another on a central hub. Wherein each hinge pivotally attaches one or more tools, and the central hub is attached to an additional tool, or is integral with the additional tool arm, that does not pivot with respect to the central hub.

r) To provide a multitool set where two hinge axes are not parallel to one another on a central hub. Wherein each hinge pivotally attaches one or more tool arms, and the central hub is attached to an additional tool arm or is integral with the additional tool arm that does not pivot with respect to the central hub.

s) To provide a multitool set that can fold to less than seventy percent (<70%) of its fully extended length when not being used and where the multitool has three or more wrench heads with a turning axis designed to align with the axis of a rotary fastener for applying a torque to that fastener. Wherein the turning axis (gripping surface axis) of the wrench heads can be oriented to within thirty degrees of perpendicular with its respective arm's longitudinal axis.

t) To provide a folding multitool wherein each folding tool arm has three operational modes comprising a substantially stowed mode (position) for compact storage, a handle mode where the tool arm is used as a handle of the wrench, and an operational mode where the wrench head of that tool arm is used to apply torque to a rotary fastener.

u) To provide a folding multitool with three, four, five, six, seven, eight, nine, or more tool arms pivotally connected at one end to a central hub and a multi-size wrench head mounted on at least two of the pivotally connected tool arms.

v) To provide a folding multitool with one, two, three, four, five, six, seven, eight, nine, or more tool arms each with a duplex wrench head at one end, wherein the tool arms are pivotally connected at the other end to a central hub to provide a folding multitool with two, four, six, eight, ten, twelve, fourteen, sixteen, eighteen, or more wrench sizes, respectively (see FIGS. 6A and 7A).

w) To provide a folding multitool with one, two, three, four, five, six, seven, eight, nine, or more tool arms each with an overlapped duplex wrench head at one end, wherein the tool arms are pivotally connected at the other end to a central hub provide a folding multitool with four, eight, twelve, sixteen, twenty, twenty-four, twenty-eight, thirty-two, thirty-six or more wrench sizes, styles and/or types, respectively (see FIG. 7A).

x) To provide a folding multitool with one, two, three, four, five, six, seven, eight, nine, or more tool arms each with an overlapped wrench head at one end, wherein the tool arms are pivotally connected at the other end to a central hub provide a folding multitool with two, four, six, eight, ten, twelve, fourteen, sixteen, eighteen, or more wrench sizes, respectively (see FIG. 7A).

y) To provide a folding multitool with one, two, three, four or more tool arms each with a quad wrench head (four fixed sizes) on one end and pivotally connected to a central hub at the other end, wherein four, eight, twelve, sixteen, or more wrench sizes, respectively, can be obtained. Where each quad wrench heads can be box-end style wrench heads, open-end style wrench heads, and/or a combination of the two styles.

z) To provide a folding multitool with one, two, or more tool arms each with an adjustable wrench head for a full range of sizes, wherein the tool arms can be pivotally connected together at a hinge with a hinge axis. Further comprising one or more tool arms each with a fixed-sized wrench head and pivotally mounted such that its hinge axis is not substantially parallel to at least one other hinge axis.

aa) To provide a folding multitool with three or more tool arms where at least one arm comprises a tool other than a wrench, such as, screwdriver, knife, hammer, pry bar, pliers, ratchet head, etc.

bb) To provide a folding multitool with six or more wrench sizes (gripping surface sizes), and a screwdriver with one or more bit sizes and/or styles, a hammer, a pair of pliers, a knife, a pry bar, ratchet head (for turning sockets), and/or other hand tool (see FIGS. 4C, 5A, 6B, and 7A-B). Where two or more folding hinge axes are defined for the six or more wrench sizes are greater than thirty degrees away from parallel with each other.

cc) To provide a folding multitool with three, four, five, six, seven, eight, nine, or more tool arms where one arm is fixed to a central hub so that it can not pivot with respect to the central hub during use. And the other tool arms are pivotally mounted to the central hub and can each fold longitudinally adjacent one another for stowage.

dd) To provide a folding multitool with multiple pivotal tool arms and a center tool arm, where the tool arms can fold to a substantially stowed position (arms longitudinally adjacent) and has at least two pivotal arm with folding axes that are not substantially parallel, and where the tool arms define a full set of six or more wrench sizes, and define at least one other non-wrench tool, such as screwdriver, hammer, knife, pliers, pry bar, specialty tools, or other tools.

ee) To provide a folding multitool with an elongated central hub with multiple pivotal tool arms, where the length of the elongated central hub comparable to the length of the pivotal tool arms. Therein multitool can fold to less than fifty percent (50%) of its fully extended length.

ff) To provide a folding multitool with multiple pivotal tool arms and a center tool arm, where the tool arms can fold to a substantially stowed position (arms longitudinally adjacent) and has at least two pivotal arm with axes that are more than thirty degrees from being exactly parallel, and where the tool arms define a full set of six, seven, eight, and/or more wrench and/or socket sizes, and define at least one other non-wrench tool, such as screwdriver, hammer, knife, pliers, pry bar, specialty tools, or other tools.

gg) To provide a folding multitool with multiple pivotal tool arms and a center tool arm, where the tool arms can fold to a substantially stowed position (arms longitudinally adjacent) and has at least two pivotal arm with axes that are more than thirty degrees from being exactly parallel, and where the tool arms define a full set of six, seven, eight, and/or more wrench and/or socket sizes, a reversible ratchet wrench head, and at least one other non-wrench tool, such as screwdriver, hammer, knife, pliers, pry bar, specialty tools, or other tools.

hh) To provide a folding multitool with multiple pivotal tool arms and a center tool arm, where the tool arms can fold to a substantially stowed position (arms longitudinally adjacent) and has at least two pivotal arm with axes that are more than thirty degrees from being exactly parallel, and where the tool arms define a full set of six, seven, eight, and/or more wrench and/or socket sizes, a screwdriver, and at least one other non-wrench tool, such as screwdriver, hammer, knife, pliers, pry bar, specialty tools, or other tools.

ii) To provide a folding multitool with two central hubs pivotally connected to each other and able to pivot between a stowed position and an extended position. Two or more pivotal tool arms attached to each central hub.

jj) To provide a folding multitool with two central hubs pivotally connected to each other and also foldable tool arms and foldable between a stowed position and an extended position, and where the two central hubs are detachable so that each central hub and its tools can be used separately.

kk) To provide a folding multitool with two central hubs attached at opposite ends of a center arm and able to pivotally attach tool arms that can pivot between a stowed position and an extended position.

DRAWING FIGURES

FIG. 1A Prior Art—Folding multitool with three tool heads.

FIG. 1B Exploded perspective view of folding multitool 60 in schematic with three folding tool arms and three tool heads. Tool arm 62 with an axis for folding hinge pin 67 that is approximately perpendicular to the axis of the other arms hinge pin 57.

Figure 1C:
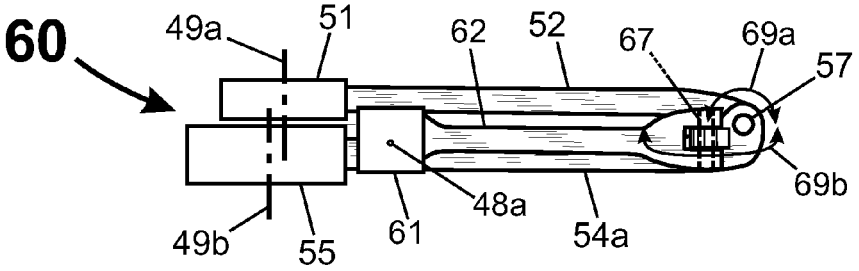

FIG. 1C Side-view of the assembled folding multitool seen in FIG. 1B.

FIG. 2A Exploded perspective view of folding multitool 80 in schematic with four tool arms and four wrench heads. Tool arm 62 with an axis for folding hinge pin 67 that is approximately perpendicular to the axis of the other arms hinge pin 57.

FIG. 2B Side-view of the assembled folding multitool with five tool arms.

FIG. 2C Side-view of the assembled folding multitool seen in FIG. 2B with added pivot stops.

Figure 3A:
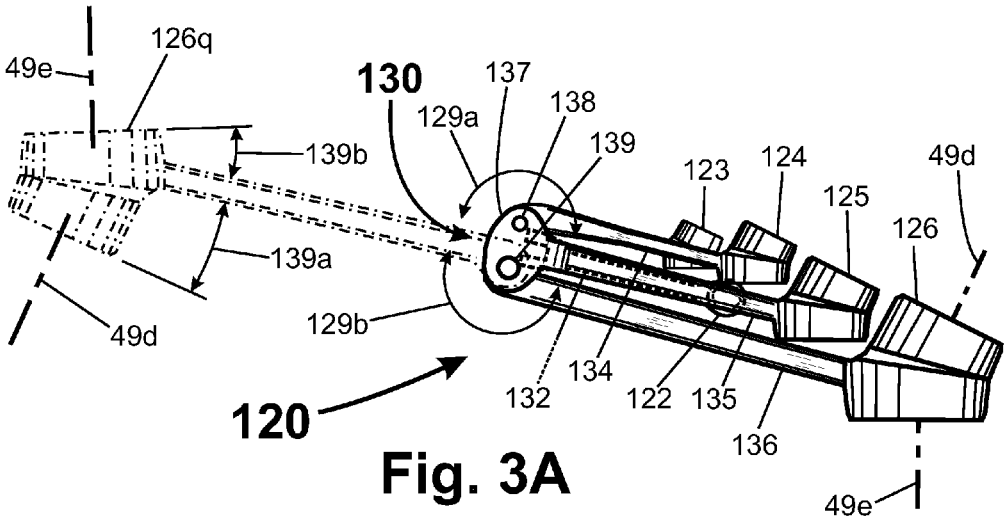

FIG. 3A Side-view of the assembled folding multitool 120 with fixed center arm 135.

Figure 3B:
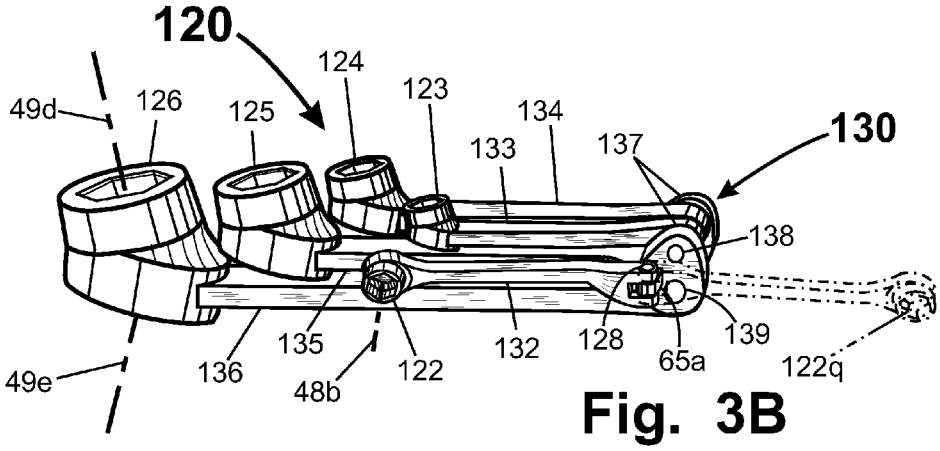

FIG. 3B Perspective view of folding multitool 120 seen in FIG. 3A.

Figure 3C:
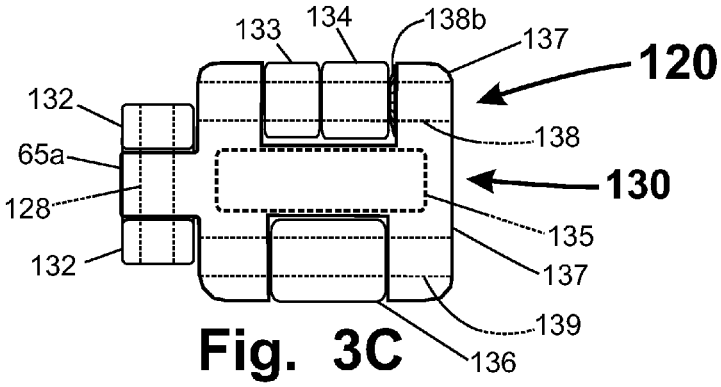

FIG. 3C End-view of folding multitool 120 seen in FIG. 3A showing central hub 130.

Figure 4A:
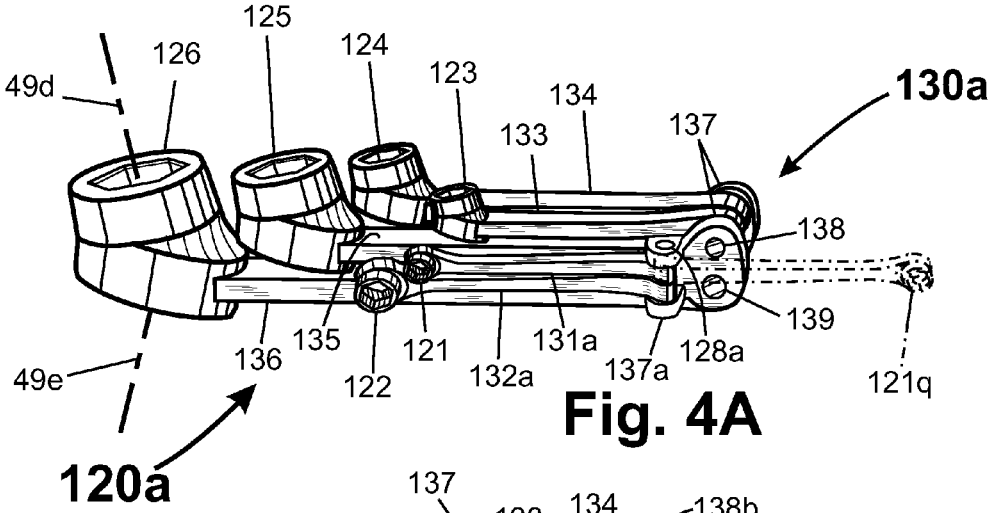

FIG. 4A Perspective view of multitool 120*a* comprising six tool arms and six wrench heads.

Figure 4B:
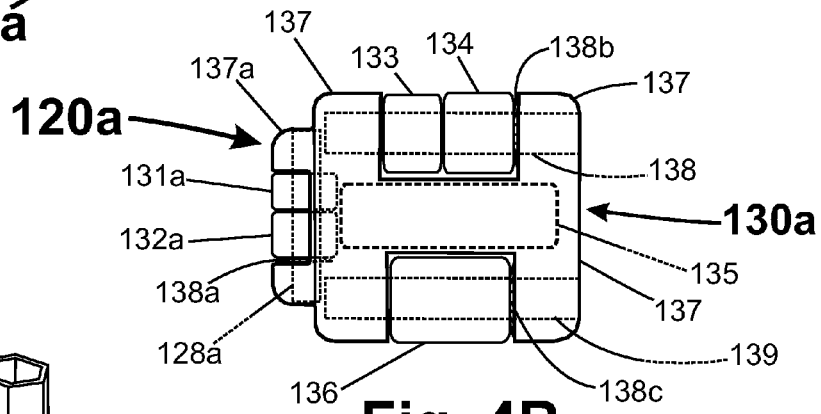

FIG. 4B End-view of folding multitool 120*a* seen in FIG. 4A showing central hub 130*a* and attached tool arms (wrench heads are not shown here to keep the drawing readable).

Figure 4C:
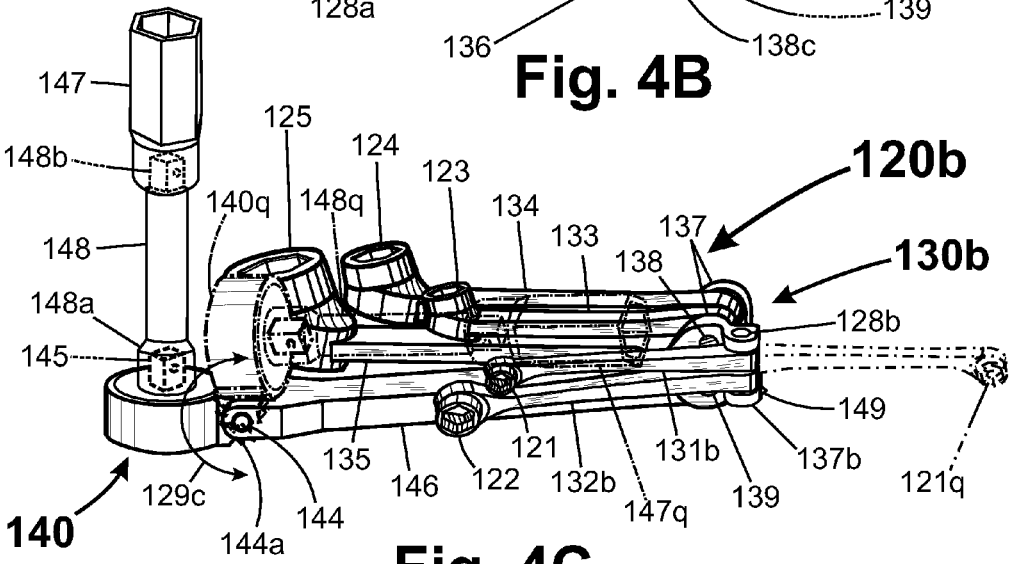

FIG. 4C Perspective view of multitool 120*b* comprising six tool arms: five with duplex box end wrench heads (10 wrench sizes), and one with a swivel mounted reversible ratchet head (for standard ratchet sockets).

Figure 5A:
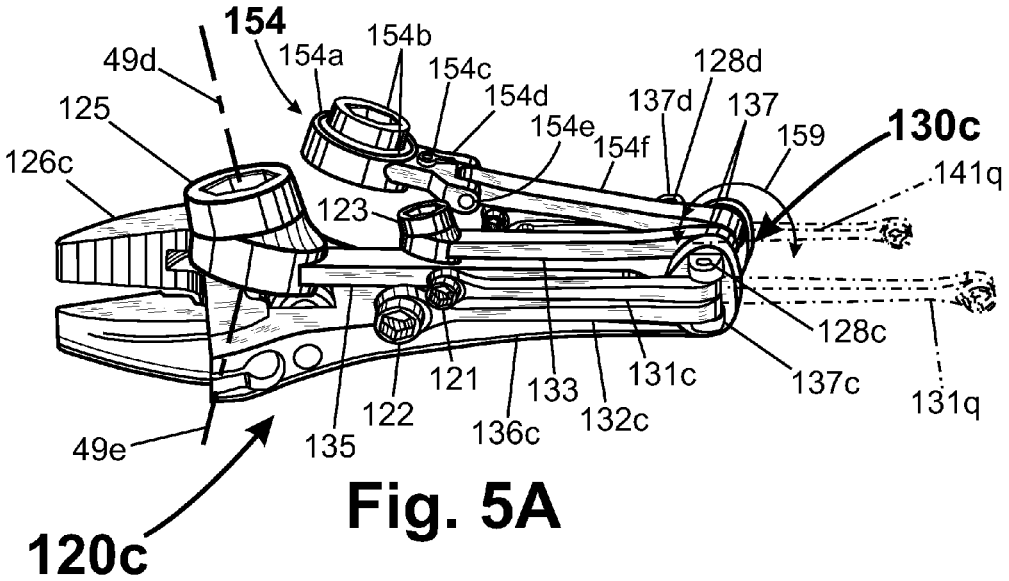

FIG. 5A Perspective view of multitool 120*c* comprising eight tool arms: one with an adjustable crescent style wrench, and seven with a duplex wrench head. One duplex wrench heads also has a reversible ratchet and a pivot joint.

Figure 5B:
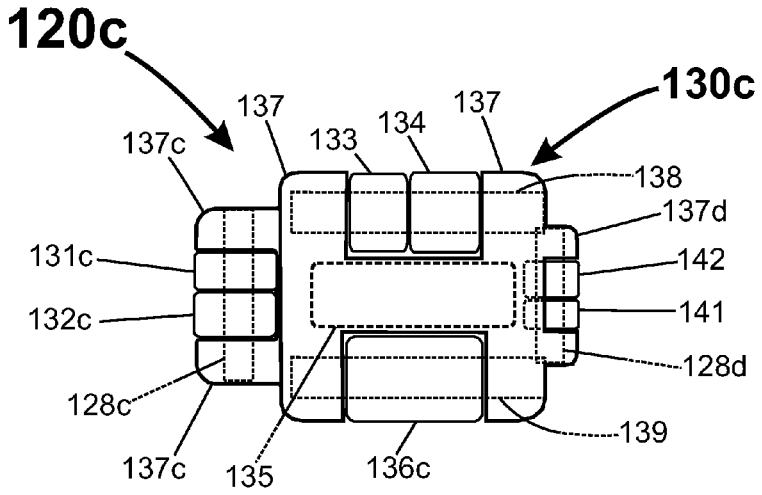

FIG. 5B End-view of folding multitool 120*c* seen in FIG. 5A showing central hub 130*c* and attached tool arms (wrench heads are not shown to keep the drawing readable).

FIG. 6A Perspective view of multitool 120*d* comprising eight arms: seven with a duplex wrench head, and one arm with a hammer and claw.

Figure 6B:
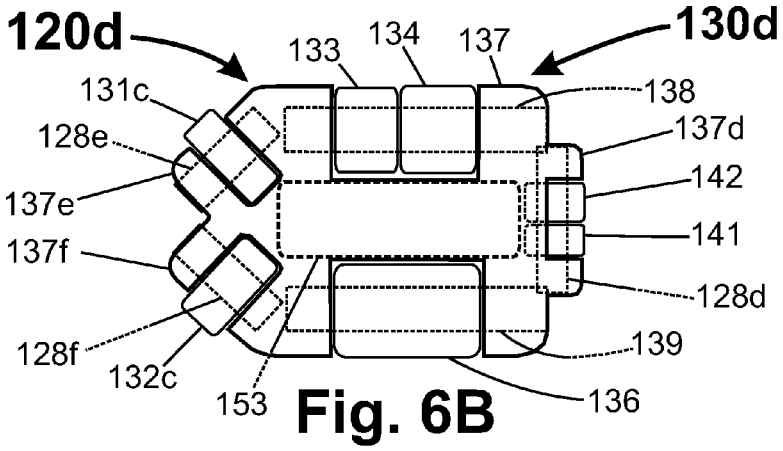

FIG. 6B End-view of folding multitool 120*d* seen in FIG. 6A showing central hub 130*d* and attached tool arms (wrench heads are not shown to keep the drawing readable).

Figure 6C:
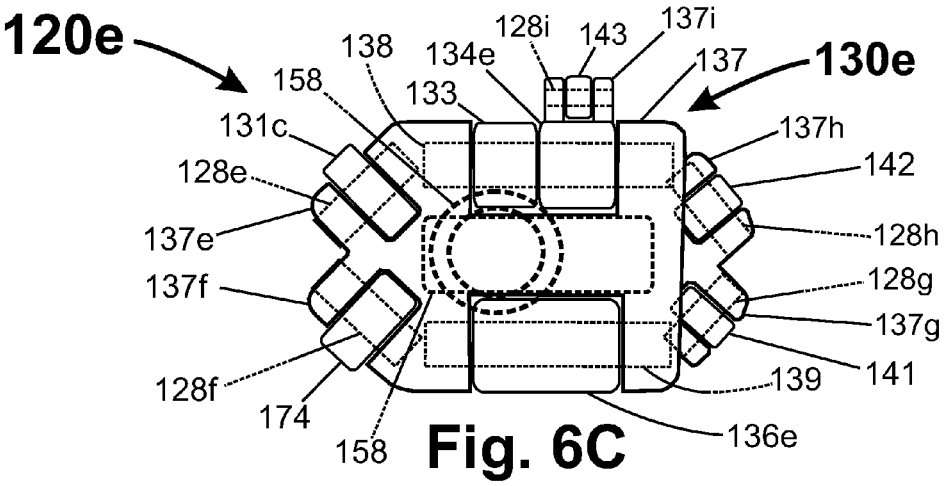

FIG. 6C End-view of folding multitool 120*e* seen in FIG. 7A showing central hub 130*e* and attached tool arms (wrench heads are not shown to keep the drawing readable).

FIG. 7A Perspective view of multitool 120*e* comprising nine arms: 5 with a duplex wrench head (including two arms mounted on hinge pin 128*h* (see FIG. 6A), 2 with an overlapped duplexed wrench head (124*e* & 126*e*—four sizes each), 1 with a double ended pivotal socket, and 1 with an interchangeable screwdriver 155 with two double-ended bits.

Figure 7B:
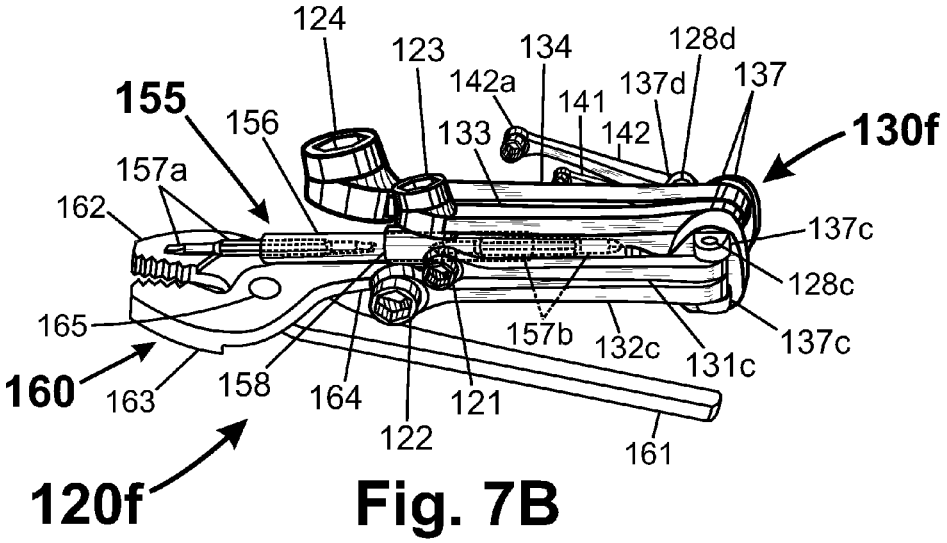

FIG. 7B Perspective view of multitool 120*f* comprising eight arms: six with a duplex wrench head (two not seen on hinge pin 128*d*, see FIG. 8A), one with an interchangeable screwdriver with two double-ended bits, and one arm acting as the right handle of pliers 160.

Figure 8A:
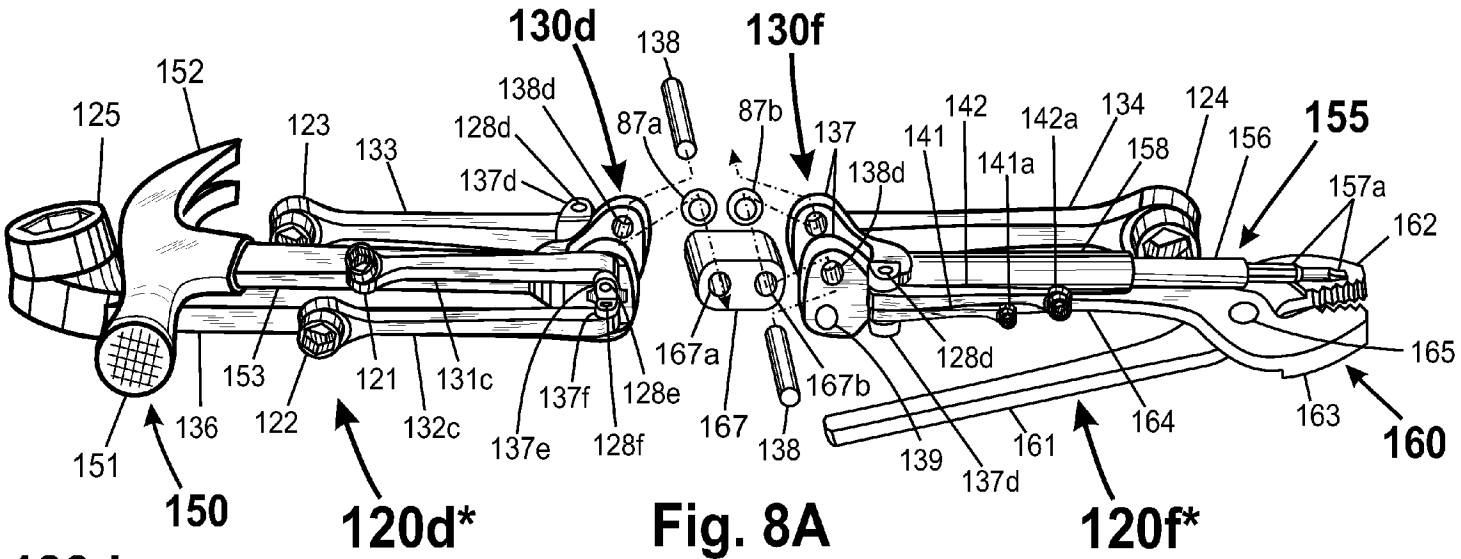

FIG. 8A Perspective view of multitools 120*d* and 120*f* coupled together, comprising ten arms: seven with duplex wrench heads, one hammer, one pair of pliers, and one interchangeable screwdriver with two double-ended bits.

Figure 8C:
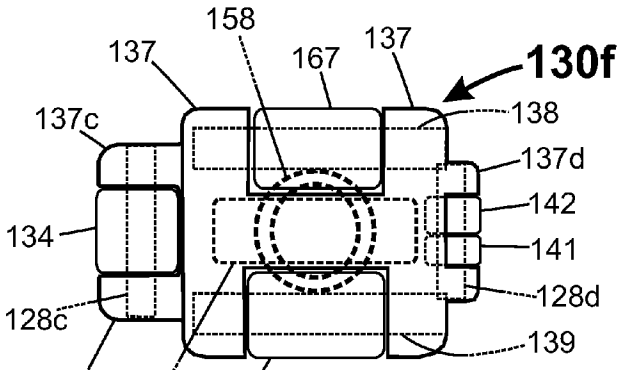
Figure 8B:
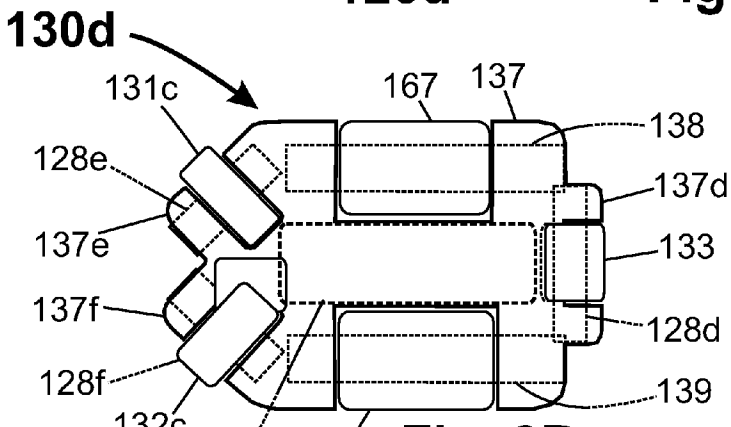

FIG. 8B End view of multitool 120*d showing connector 167 attached and tool arms 133 substituting for tool arms 141 and 142**.

FIG. 8C End view of multitool 120*f showing connector 167 attached and tool arm 134 substituting for tool arms 131***c* and 132*c*.

Figure 9A:
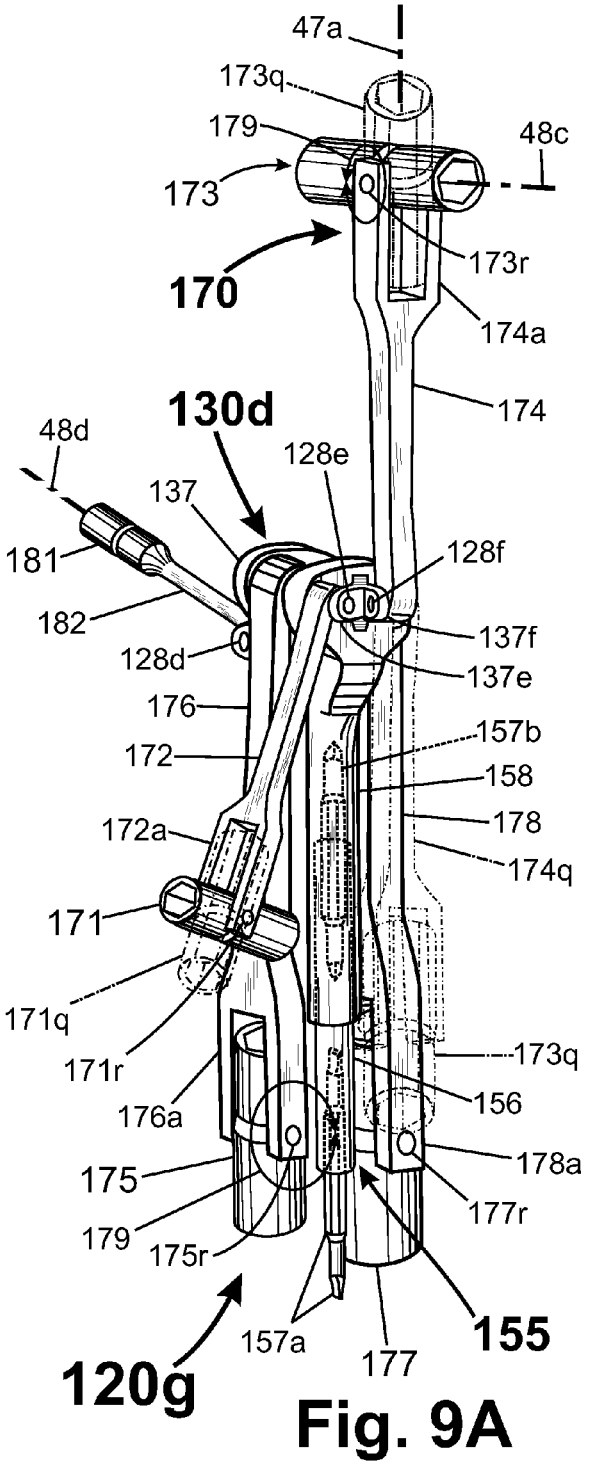

FIG. 9A Perspective view of multitool 120*g* comprising six arms: four with a double-headed pivotal socket, one with a single size socket 181, and one arm with an interchangeable screwdriver 155 with two double-ended bits.

Figure 9B:
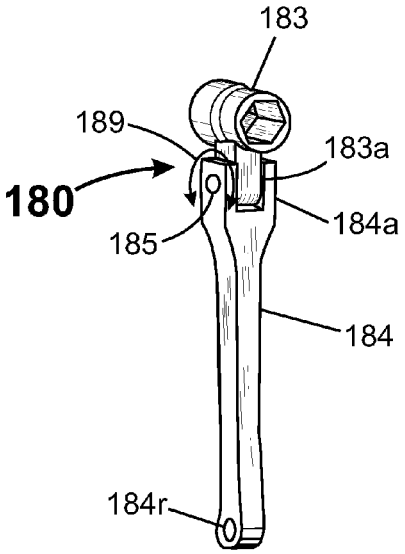

FIG. 9B Perspective view of pivotal duplexed wrench 180, with pivotal duplexed wrench head 183.

FIG. 10 Perspective view of multitool 120*h* comprising four arms pivotally attached to an elongated central hub: four double-headed pivotal socket—two pivotal sockets per end of the elongated central hub.

DETAILED DESCRIPTION OF THE INVENTION

All of the multitools disclosed in this patent would generally be made of a hardened metal or metal alloy such as high carbon steel, chrome vanadium steel, stainless steel, titanium, aluminum, cobalt alloys, etc. The materials used to make the disclosed multitool are not limited to metals, and other materials like plastics and composite materials can be used depending on the tool. The standard manufacturing methods of drop forging and machining, injection molding, extrusion, etc. can be used here to manufacture the disclosed multitool. The use of press fitted pivot pins and/or screwed in pivot pins can provide assembly that is typical of existing wrenches and tools. Chrome vanadium steel is popular for wrenches, ratchets, hammers, screwdrivers, etc. because of its combination of relatively inexpensive cost, high strength, and good corrosion resistance. Standard tool manufacturing techniques can be used to construct the disclosed wrenches and other tools. Hinge construction on these multitools can comprise nearly any hinge structure that can support the torques and loads that will be applied perpendicular to the hinge axis during use. The folding hinges' axis can be oriented substantially perpendicular to the tools gripping surface turning axis (rotational axis) so that the hinges do not need a locking mechanism in order for the user to transfer torque through the hinge to the rotary fastener. This means that when turning a vertical axis fastener the wrench hinge(s) are oriented substantially parallel to the horizontal plane that is normal (perpendicular along two axes) to the fastener's turning axis. A locking mechanism can be used on the folding hinges to prevent pivoting of the hinges during use, if desired, and any of the multitude of existing hinge locking methods can be used.

Another way to think about this relationship between the axis of the hinge and the axis of the wrench head's gripping surface is to realize that the axis of a bolt placed on the wrench head's gripping surface will point substantially in the same direction as the axis of the gripping surface. This means that the turning axis of the bolt is substantially parallel and aligned with the axis of that gripping surface. In the presented designs, the axis of the gripping surfaces can also be substantially perpendicular to the pivoted axis of the tool arm's folding hinge. This arrangement not only provides the ability to transfer torque from one end of the multitool to the other without a locking mechanism, but it also allows for a more vertically compact hinge arrangement. Because the folding hinge axis is substantially parallel to the direction a user naturally applies force to the extended arm to turn a fastener, the hinge resists pivoting because the force is applied substantially perpendicular to the hinge axis. This tends to lock the hinge in place due to friction during use even though the folding hinge can still be pivoted.

In the discussion of these multitools, the geometry of the tool heads and hinges are critical. Many wrench head gripping surfaces discussed in this patent are angled at approximately fifteen degrees away from the tools arm. For a vertical axis rotary fastener this angle allows the tool arm to be angled upward and away from the horizontal plane normal to the axis of the rotary fastener and provide room for the user's fingers between the tool arm and the horizontal surface (which often involves a real surface). Many of the wrench heads disclosed in this patent have this approximately fifteen degree angle, though other angles are often used. However, as this upward angle becomes greater than thirty degrees the wrench starts to become less stable and can also reduce the amount of torque that can be applied to the rotary fastener. Each wrench head can also have two or more wrench gripping surfaces. Many of the disclosed multitool heads can have many separate wrench tool axes (gripping surfaces) that are not aligned with each other (see FIG. 4A). Thus, each gripping surface on a wrench can have this fifteen to thirty degree upward angle if desired.

In FIG. 1A we see prior art multi-size wrench systems for providing more than one fixed wrench size in the same wrench head. Many other prior art multi-sized wrench heads exist that are designed to grip a range of rotary fastener sizes, or are designed to be adjustable. Thus, wrench heads 51 and 55 shown as boxes, comprised any of a number of multi-size wrench heads, or other tools, to provide the disclosed folding multitool with a very ergonomic tool system. Nearly all wrench styles and wrench types that exist in the prior art can be utilized by the disclosed folding wrench technology. Note that both variable size (adjustable) wrenches and fixed-size(s) wrench heads can be used. This is not meant to limit the scope or types of wrench heads that can be used with the disclosed folding multitool technology, but is instead meant to familiarize the reader with some multi-size wrench types they may not know about.

In FIG. 1A we see an assembly view of a prior art folding multiwrench 50 (multitool) drawn in schematic form, comprising a small sized wrench head 61 (tool head), a small sized pivotal tool arm 62 with a hinge paw 68 defining a pair of pivot hole 63, a hinge pin 67, a friction spring washer 67*a*, a medium sized wrench head 51 (tool head), a medium sized pivotal tool arm 52, a pivot hole 53, a pivot pin 57, a friction spring washer 57*a*, a large sized wrench head 55 (tool head), a large sized pivotal tool arm 54 (center tool arm), a hinge paw 58 with a pair of pivot holes 56, and a hinge post 65 with a pivot hole 66. In the prior art, tool heads 51, 55, and 61 would comprise various wrench heads. In this patent, the types of tool heads that can be used are more diverse, and can include many non-wrench tools.

In FIG. 1A, assembly path 59 shows pivot pin 57 pressed through pivot paw holes 56, friction spring washer 57*a*, and pivot hole 53. Spring washer 57*a* is compressed between hinge paw 58 (pivot connector) and the end of tool arm 52 to provide a consistent pressure on the contact surfaces (inside of paw 58 and outside of arm 52) to provide friction to resist pivoting. The result is a constant frictional resistance that allows smooth pivoting of tool arms 52 and 54 and also a holding force during use. Attached under hinge paw 58 is hinge post 65 with pivot hole 66. Tool arm 62 is pivotally attached to hinge post 65 with hinge pin 67 that is pressed through hinge paw holes 63, friction spring washer 67*a*, and pivot hole 66. This particular two-hinge, three-arm design can take on many forms, but is designed to have the rotational axes 49*a*, 49*b*, and 49*c* of tool heads 51, 55 and 61, respectively, substantially perpendicular to hinges defined by hinge pins 57 and 67. In this way, axes 49*a*-*c* can be substantially parallel so that wrench action is always in the horizontal plane of arms 52, 54 and 62. Thus, hinge pins 57 and 67 are taught to be substantially parallel to each other to provide good torque transfer from one pivotal arm to the other. Note that if any more than two substantially aligned parallel hinges are used on the central hub (i.e. additional hinge between hinge paw 58 and hinge post 65) the extra arms attached to such hinges would interfere with one another's ability to rotate to an extended position for use, thus, frustrating the ergonomic use of the tools (e.g. wrenches). Additional arms can be placed on the prior art wrenches by using additional parallel hinges that are located to the side of the other hinges, so that adjacent arms can rotate past one another for use. This is similar in function to placing two or more arms on a single hinge, except the hinge joints for the second arm would be offset (separate hinge) from the first, but the hinges positioned so the arms can rotate freely past one another. For example, an additional arm can be added to multiwrench 50 by widening hinge paw 58 so that the additional tool arm can be mounted on the same hinge next to arm 52 (see arms 52 and 82 in FIG. 2A). However, alternatively, a second hinge could be added slightly forward (to the left in drawing) of hinge pin 57, but offset to the side (out of the page in drawing) so that the two arms miss each other and the others hinge when individually rotated to their extended position (to the right in drawing).

In FIG. 1A we see a multiwrench 50 being assembled in substantially its stowed position with arms 52, 54 and 62 substantially adjacent each other. The rotational axis for hinge pins 57 and 67 with pivot holes 56 and 66, respectively, are substantially perpendicular to tool head turning axes 49*a-c* at all orientations of arms 52, 54, and 62. This allows the arms to provide torque across the hinge. Arms 52, 54 and 62 are attached to tool heads 51, 55 and 61, respectively, so that the tool heads fold substantially adjacent to one another when in their stowed position. Both arms can rotate about one hundred eighty degrees with respect to each other. For example, if tool head 51 and arm 52 are pivoted to the right, gripping surface axis 49*a* can be aligned with a rotary fastener so that tool head 51 can grip that fastener, while arms 54 and 62, and tool heads 55 and 61 can then be gripped as the handle for turning the fastener. Tool heads 51, 55 and 61 can be designed to fit multiple sizes of rotary fasteners, and can comprise an adjustable wrench head, duplex wrench head, quad wrench head, etc.

As we will see in the following examples, this ability to place additional hinges on the sides of the central hub allows more tool arms to be attached to the central hub than previous folding wrenches designs which required all the hinge axes to be substantially parallel to each other. In previous designs by the Applicant, the number of hinges was limited to two hinges per central hub, but by preventing any pivoting of the center arm with respect to the central hub six or more hinges can be ergonomically placed around the central hub with their tool arms free to fold between a stowed position and an extended position.

In FIG. 1B we see a first embodiment of the invention in exploded view. Folding multitool 60 shown being assembled in its stowed position, and comprising a small tool head 61 attached to a small pivotal arm 62 with a hinge paw 68 and a pair of pivot holes 63, a hinge pin 67, a friction spring washer 67*a*, a tool head 51 attached to a pivotal arm 52 with a pivot hole 53, a hinge pin 57, a friction spring washer 57*a*, a large tool head 55 attached to a large pivotal arm 54*a*, a hinge paw 58 with a pair of pivot holes 56, and a hinge post 65*a* with a pivot hole 66*a*. The central hub in this embodiment is attached securely to arm 54*a* and comprises hinge paw 58 with pivot holes 56 and hinge post 65*a* with pivot hole 66*a*. Assembly path 59 shows hinge pin 57 pressed through pivot paw holes 56, friction spring washer 57*a*, and pivot hole 53. Spring washer 57*a* is compressed between hinge paw 58 (pivot paw) and the end of tool arm 52 to provide a consistent pressure on the contact surfaces (inside of paw 58 and outside of arm 52) to provide friction to resist pivoting. The result is a constant frictional resistance that allows smooth pivoting of arms 52 and 54 and also a holding force once positioned for use. Assembly path 69 shows hinge pin 67 pressed through hinge paw holes 63, friction spring washer 67*a*, and pivot hole 66*a*. Pivot axis 89*b* shows the pivot axis of hinge pin 67, and the vertical pivot axis of tool arm 62 once pin 67 is inserted into hinge paw holes 63 and hinge post hole 66*a* as shown by assembly line 69. Spring washer 67*a* is compressed between hinge paw 68 (pivot connector) and horizontal hinge post 65*a* to provide a consistent pressure on the contact surfaces (inside of paw 68 and outside of post 65*a*) to provide friction to resist pivoting. This particular two-hinge, three-arm design represents the minimum configuration for the disclosed invention where two folding hinges have axes that are not substantially parallel to each other and the central hub (hinge paw 58 and hinge post 65*a*) is securely attached to center arm 54*a* so that arm 54*a* cannot rotate with respect to the center hub. In this particular design arm 54*a*, tool head 55, paw 58 and post 65*a* can comprise a single piece of drop forged tool steel.

In prior art designs the gripping surface axes 49*a-c* were substantially parallel to each other. One of the distinguishing features of the disclosed invention is that at least one gripping surface axis (i.e. rotational axis 48*a*) is not substantially parallel to at least one other gripping surface axis (i.e. axes 49*a* and 49*b*). This in turn requires the hinge axes of pins 57 and 67 in multitool 60 to be substantially perpendicular to their respective gripping surface rotational axes 48*a* and 49*a* if no locking mechanism is used to prevent the pivoting of the hinges during use. Thus, for the disclosed invention at least one hinge can be substantially not parallel to one of the other hinges (i.e. hinge pin 57 is approximately perpendicular to hinge pin 67, which is substantially not parallel).

In FIG. 1B, arms 52 and 62 can pivot (fold) along an arc of approximately one-hundred eighty degrees or more. Because both arms can fold around a single hub (central hub), they can be pivoted to a position where they are substantially adjacent as shown in FIG. 1C. This gives multitool 60 a compact stowed position that allows one side of the tool heads 51, 55 and 61 to be used while stowed. This give this multitool 60 the ability to be used like a short handled wrench when folded as shown in FIG. 1C. By rotating one or both of the pivotal folding arms 52 and 62 to the right, both sides of any of the tool heads can be used to directly turn a fastener, while the other tool arms and tool heads can be used as an extended handle during use. For example, if arms 52 and 62 are rotated to the right, then arm 54*a* and tool head 55 will remain by itself on the left for used in turning a fastener, while on the right arms 52 and 62 can be gripped by the user as an extension for arm 54*a*. The perpendicular orientation of hinge pin 57 relative to gripping surface axis 49*b* allows torque that is applied to arm 52 to be transferred to arm 54*a* and turn a fastener along rotational axis 49*b* without the need of a locking mechanism for the hinge (hinge pin 57). In the same way, the perpendicular orientation of hinge pin 67 relative to gripping surface axis 48*a* allows torque that is applied to arm 54 and/or tool head 55 to be transferred to arm 62 and turn a fastener along axis 48*a*. This is all possible because center arm 54*a* is securely attached to the central hub (hinge paw 58 and hinge post 65*a*) and cannot pivot with respect to the central hub. If dual, or quad wrench heads are used for tool heads 51, 55, and 61, this design can have six or twelve wrench sizes, respectively. This particular two-hinge, three-arm design can have many forms that incorporate additional tool arms. For example, multitool 120 in FIGS. 3A-C would have substantially the same tool arrangement seen in multitool schematic 60 if arms 133 and 136 were removed.

In FIG. 1C, we see a side view of multitool 60 fully assembled and in its stowed position (longitudinally adjacent). Both arms 52 and 62 can pivot approximately one-hundred eighty degrees away from center arm 54*a* as shown by arrows 69*a* and 69*b*, respectively. Both tool head axes 49*a-b* are vertical in this drawing, while tool head axis 48*a* is pointing out of the page. This stowed position places tool arms 52, 54*a*, and 62 substantially parallel to a center axis of the multitool, and lengthwise adjacent each other (longitudinally adjacent to each other).

In FIG. 2A we see a second embodiment the invention in exploded schematic view. Multitool 80 comprises four tool arms 52, 62, 82, and 84, each with one of four tool heads 51, 61, 81, and 85, respectively. Folding multitool 80 is shown being assembled in its stowed position, and comprises nearly the same configuration as multitool 60 with an addition tool arm. Multitool 80 comprises a small tool head 61 attached to a small pivotal arm 62 (folding arm) with hinge paw 68 and a pair of pivot holes 63, a hinge pin 67, a friction spring washer 67*a*, a next larger tool head 51 attached to a pivotal arm 52 (folding arm) with a pivot hole 53, a hinge pin 57, a friction spring washer 57*a*, a large tool head 81 attached to a large pivotal arm 82 (folding arm) with a widened hinge paw 88 with a pair of pivot holes 86, and a hinge post 65*a* with a pivot hole 66*a* and a largest tool head 85 connected to a largest pivotal arm 84 (folding arm) with a pivot hole 83. Tool head 81 can be the same size and type as tool head 55 so that tool head 85 adds a size larger tool to multitool 80 compared to multitool 60. The central hub in this embodiment is attached securely to arm 84 and comprises hinge paw 88 with pivot holes 86, and hinge post 65*a* with pivot hole 66*a*. Assembly path 89 shows hinge pin 87 pressed through pivot paw holes 86, friction spring washer 57*a*, pivot hole 53, and pivot hole 83. Pivot axis 89*a* shows the pivot axis of hinge pin 87, and the horizontal pivot axis of tool arms 52 and 82 once pin 87 is inserted into hinge paw holes 86 and arm hinge holes 53 and 83, as shown by assembly line 89. Spring washer 57*a* is compressed between hinge paw 88 (pivot paw) and the end of tool arm 52 to provide a consistent pressure on the contact surfaces of paw 88, arm 52, and arm 82. The result is a constant frictional resistance that allows smooth pivoting of arms 52, 82 and 84 with respect to each other and also a holding force once positioned for use. Assembly path 69 shows hinge pin 67 pressed through hinge paw holes 63, friction spring washer 67*a*, and pivot hole 66*a*. Spring washer 67*a* is compressed between hinge paw 68 (pivot connector) and horizontal hinge post 65*a* to provide a consistent pressure on the contact surfaces (inside of paw 68 and outside of post 65*a*) to provide friction to resist pivoting. This particular two-hinge, four-arm design provides two folding hinges with axes that are substantially perpendicular (and not substantially parallel) to each other and the central hub (hinge paw 88 and hinge post 65*a*) is securely attached to center arm 84 so that arm 84 cannot rotate with respect to the center hub. In this particular design, arm 84, tool head 85, hinge paw 88 and post 65*a* can comprise a single piece of drop forged tool steel.

In FIG. 2B we see a third embodiment the invention in side view. Folding multitool 90 is substantially the same as multitool 80 with an addition additional tool arm 94 and tool head 95. This gives this third embodiment five tool arms and five tool heads. Central hub 70 comprises hinge paw 88 for receiving folding hinge pin 87, hinge post 98 for receiving folding hinge pin 97, and hinge post 65*a* for receiving folding hinge pin 67. Lower hinge post 98 has been added to the central hub (upper paw 88, and hinge post 65*a*) of multitool 80 so that arm 94 can be attached with hinge pin 97. Thus, in this embodiment, the central hub is attached securely to arm 84 and comprises hinge paw 88 with pivot holes 86, hinge post 65*a* with pivot hole 66*a*, and hinge post 98 with a pivot hole for hinge pin 97. The larger additional tool comprises arm 94 with a pivot hole for both a hinge pin 97 and a hinge pin 96, and a tool head 95. Arm 94 attaches to hinge post 98 with hinge pin 97 to provide a folding hinge for arm 94 and tool head 95. Tool head 95 is also pivotally mounted to the other end of tool arm 94 with hinge pin 96 so that tool head 95 can pivot with respect to arm 94 to a plurality of angles to engage objects at different orientations and in tight places.

In FIG. 2B tool arm 62 is shown in shadow lines in its extended position 62*q* for use. Similarly, tool head 81 and tool arm 82 are shown in shadow lines in a partially extended positions 81*q* and 82*q*, respectively. Each arm in this example has approximately a two-hundred degrees of pivot range. This allows the arms to position the tool heads as needed to get into tight places. The pivot range of arm 82 is shown by double arrow lines 99. The other arms have a similar range of motion. Notice that gripping axis 49*b* of tool head 81 can be used at various angles to reach fasteners in tight spaces. This position places tool arms 52, 62, 82, 84, and 94 substantially parallel to each other and lengthwise adjacent each other (longitudinally adjacent to each other). Notice that the small off-angle of arm 52 is well within twenty degree of being exactly parallel to the center axis of the multitool (center axis can be parallel to the longitudinal axis of arm 84 in this example).

One of the key elements of the disclose invention is that there is at least one tool arm that can apply torque to the central hub in each direction of rotation. This allows the orientation of the pivotal axes of the tool arms to be oriented in any direction and still allow torque to be properly applied to those tools during use. One way this is done, and it is the preferred way, is to securely fix the center arm to the central hub so that they act as a single structure or part. The center arm is preferably fixed to the central hub because this allows a pivotal arm to be placed on the left, right, top and bottom of the central hub and still be able to fold out for use. An outside arm can be fixed to the central hub to provide the same omnidirectional torque application, but this can limits the maximum number of tool arms that are possible because a pivotal arm cannot be placed in the direction of that fixed arm (otherwise it becomes a center arm). While a fixed center arm is the preferred configuration, there are many other ways that omnidirectional torque can be applied to the central hub without fixing an arm to the central hub. For example, a tool arm might be allowed to rotate about its longitudinal axis (twist), but not limit the ability of the tool arm to apply a pivoting torque to the center hub. Also, all the tool arm can be pivotally mounted to the center hub as long as pivot stops are provided along two axes. In FIG. 2C, two pivot stops 71 and 72 are shown for providing this omnidirectional torque to a central hub 70*a*.

In FIG. 2C, we see central hub 70*a* with a construction similar to central hub 70, but with the addition of an extended section comprising a top pivot stop 71, a bottom pivot stop 72 and a folding hinge 77 (central arm folding hinge) for arm 84*a*. Arm 84*a* can support the same tool head 85 as seen in FIG. 2B. Thus, central hub 70*a* comprises hinge paw 88 for receiving folding hinge pin 87, hinge post 98 for receiving folding hinge pin 97, hinge post 65*a* for receiving folding hinge pin 67, a hinge paw 76 for receiving folding hinge pin 77, a top pivot stop 71 for stopping pivoting action of arms 52 and 82, and bottom pivot stop 72 for stopping the pivoting action of arm 94. The remainder of this multitool can be the same as multitool 90 seen in FIG. 2B. Because folding hinge pins 77, 87, and 97 are substantially parallel to each other, pivotal torque can be transferred from one hinge to the other without the need for a locking mechanism. However, folding hinge pin 67 (see FIG. 2A) is substantially perpendicular to hinge pins 77, 87, and 97, and as such, cannot receive pivotal torque from hinge pins 77, 87, and 97 directly without some locking or stopping mechanism because there is no longer a fixed center arm 84 to provide torque. In FIGS. 2B-C the axis of rotation for tool head 61 (i.e. for a wrench its gripping surface axis) is out of the page toward the reader (see axis 48*a* in FIG. 2A). To transfer pivotal torque to arm 62 (torque to pivotal axis 48*a*) from arms 52, 82, 84*a*, and/or 94 the pivoting action of at least one of the user gripped arms (arms 52, 82, 84*a*, and/or 94 when using tool head 61) must be stopped from rotating in both the clockwise and counter-clockwise directions. For example, when tool arm 62 is extended to the right as seen in FIG. 2C, pivot stop 71 stops the rotation of arms 82 and 52 in the counter-clockwise to transfer that torque to arm 62 and tool 61. When applying torque in the opposite direction, pivot stop 72 stops the rotation of arm 94 in the clockwise to transfer that torque to arm 62 and tool 61. Of course, many different arrangement of stops can be used to provide at least one non-pivoting tool arm for each direction of rotation. Note that the position shown in FIG. 2C even though arm 62 is shown substantially parallel with the other arms, this is not a stowed position because tool arm 62 is not lengthwise adjacent the other arms.

In FIGS. 3A-C we see folding multitool 120 in side-view, perspective view, and end view, respectively. Multitool 120 can also be referred to as a "multiwrench" since all the tools in this example are wrenches. Thus, multiwrench 120 can comprises five tool arms 132, 133, 134, 135, and 136, each with one duplex wrench head 122, 123, 124, 125, and 126, respectively. This arrangement can give multitool 120 ten different wrench sizes that can be used. Folding multitool 120 is shown assembled in its stowed position, and has substantially the same layout as multitool 90 with the exceptions that hinge post 98 has been replaced with hinge paw 137. Multitool 120 can comprise a central hub 130, a small duplex wrench head 122 (tool head) attached to a small pivotal arm 132, a second largest duplex wrench head 123 (tool head) attached to tool arm 133, a third largest wrench head 124 (tool head) attached to tool arm 134, a fourth largest duplex wrench head 125 (tool head) attached to a tool arm 135 and a largest duplex wrench head 126 (tool head) attached to tool arm 136. Central hub 130 comprises a hinge paw 137 and a hinge post 65*a*. Hinge paw 137 is designed to accept hinge pins 138 and 139 to provide two folding hinge axes for arms 133, 134, and 136. Hinge pin 138 allows arms 133 and 134 to have a pivot range 129*a* of approximately one-hundred eighty. Hinge pin 139 allows arm 136 to have a pivot range 129*b* of approximately one-hundred eighty (see extended position in shadow lines). Hinge post 65*a* is designed to accept pivot hinge pin 128 to provide a folding hinge for arm 132. Tool arm 135 can be securely attached to central hub 130 so that it cannot pivot with respect to central hub 130. Tool arms 132, 133, 134, and 136 are pivotally attached to central hub 130. Tool arm 132 can be pivotally attached to hinge post 65*a* with hinge pin 128. Arms 133 and 134 can be pivotally attached to hinge paw 137 with hinge pin 138. Arm 136 can be pivotally attached to the lower portion of hinge paw 137 with hinge pin 139. Friction washers similar to friction spring washers 57*a* and 67*a* can be used to provide internal friction between all the tool arms and central hub 130. Friction spring washer 138*b* is shown in FIG. 3C providing frictional forces to tool arms 133 and 134. The other arms can have similar friction spring washers, but are not shown here to keep the drawing uncluttered. Each pivotal tool arm and tool head combination presented in this patent can be formed from a single drop-forged piece of tool steel with a hole made for its respective hinge pin 128, 138, or 139. For example, duplex wrench head 125, arm 135 and central hub 130 can be formed from a single drop-forged piece of steel, as can the other pivotal arms and tool head combinations presented here. Thus, wrench tool head 125, arm 135, hinge paw 137, and hinge post 65*a* can comprise a single piece of metal with holes for hinge pins 128, 138, and 139.

In FIGS. 3A-C, notice that multitool 120, with three-hinge and five-arm, provides a folding hinge pin 128 with an axis that is substantially perpendicular (and also not substantially parallel) to the other hinges (hinge pins 138 and 139). This allows arm 132 and wrench head 122 to fold to the side of the other tool arms and heads to provide a compact stowed position (tool arms longitudinally adjacent) and provide the possibility of many additional tool arms. This can be done because arm 135 is fixed to central hub 130 and can transfer torque to central hub 130 in any direction. Thus, when wrench head 122 is extended for use (see extended position 122*q* in FIG. 3B) arm 135 can provide torque substantially perpendicular to the pivotal axis of hinge pin 128 and generate torque along axis 48*b* of the gripping surface of wrench head 122. Alternatively, if arm 135 is allowed to pivot around an axis parallel to hinge pins 138 and 139, then the other arms can be designed to limit their pivoting action (i.e., a locking mechanism, or stop on central hub 130) so that arms 133, 134, and/or 136 can provide the needed torque to central hub 130 for using wrench head 122. The other arms 133, 134, 135, and 136 have parallel hinge axes so they naturally can transfer torque to the axis of their gripping surfaces (i.e., gripping surface axes 49*d* and 49*e*) which are substantially perpendicular to their folding hinge axes. In FIG. 3A, we can see that gripping surface axes 49*d* and 49*e* are angled forward of perpendicular with the longitudinal axis of arm 136 by an angle of 139*a* and 139*b*, respectively. These angles allow a more ergonomic use of the wrench gripping surfaces. Angles 139*a-b* are often chosen to be approximately fifteen degrees for standard wrenches.

In FIG. 3B, notice that multitool 120 comprises wrenches for its tools, but other tools can be added on with additional hinges, or by enlarging the existing hinges. The ability to have side hinges (see hinge pin 128) with non-parallel hinge axes, allows more tool arms (and tools) to be attached to a single folding multitool (see FIG. 7A with tool nine arms, two socket sizes, four screwdriver bit sizes, and eighteen box-end wrench sizes). Thus, the disclosed multitool designs can be customized for such things as use on an automobile. For example, a full set of tools can be incorporated into a multitool which fit a particular car model, including specialty tools specific to that particular car. Because of limited space, only examples with the most common hand tools have been shown within this patent (i.e., hammers, screwdrivers, wrenches, sockets, ratchets, ratchet wrenches, crescent wrenches, and pliers). These examples are simply the most common tools that can be used, but a vast array of other tools and specialty tools can also be included. For example, for an automotive multitool, the multitool might comprise a full set of eight wrench sizes, a ratchet wrench with an attached extension and sparkplug socket (see FIG. 4C), a screwdriver, a brake spring remover tool, a body grommet removal tool, a glass breaking tool (for emergency exits), and possibly other tools for that specific automobile. The point is, the disclosed invention allows a large number of tools to be assembled in an almost unlimited number of combinations and placed in a single folding multitool that can fit in the user's pocket.

In FIG. 3B, we see pivotal tool arm 132 with duplex wrench head 122 in its stowed position (tool arms longitudinally adjacent). Wrench head 122 is also shown in shadow lines in its extended position 122*q* for use. In this extended position, the other arms 133, 134, 135 and 136 are on the right side of hub 130 and can be used as an extended handle for wrench head 122 (in position 122*q*). In FIG. 3B, each arm 132, 133, 134 and 136 can be individually pivoted around their respective hinge pins (pivot axes) to the right-side of central hub 130 for use. When doing this, the remaining arms and tool heads can be used as an extended handle for that tool head that has been rotated to its extended position. If all the pivotal arms 132, 133, 134, and 136 are pivoted to the right side at the same time (see FIG. 3B), then arm 135 and wrench head 125 are left by themselves on the left-side of hub 130 for use, and the pivotal arms and tool heads can be used as an extended handle for the use of wrench head 125.

In FIG. 3C, spring washer 138*b* is compressed between hinge paw 137 (pivot paw) and tool arm 134 to provide a consistent pressure on the contact surfaces (inside of paw 137 and outside of arm 134). This contact force provide friction between the surfaced to resist pivoting of arm 134 with respect to central hub 130. This pressure from the spring washer is also transferred to arm 133 through arm 134 and also generates friction between arms 133 and 134, and arm 133 and hinge paw 137. Thus, friction spring washer 138*b* provides friction for both arms 133 and 134 to resist pivoting. This helps hold arms 133 and 134 in position during use. Friction spring washers can be used with all the other tool arms disclosed in this patent. Similarly other friction generating devices are well known, and can be used for generating friction between an arm and its folding hinge. The amount of friction can be tailored as desired by adjusting these friction devices. For example, a larger and/or heavier spring washer can be used to increase the friction force on the tool arms. Locking devices can also be used with the multitools disclosed in this patent. These locking devices can be used to lock a particular tool arm at a particular angle with respect to central hub 130 so that the user has a more stable wrench shape to work with.

In FIGS. 4A-B we see folding multitool 120*a* in perspective view, and end view, respectively. Multitool 120*a* can comprise six tool arms 131*a*, 132*a*, 133, 134, 135, and 136, each with one duplex wrench head 121, 122, 123, 124, 125, and 126, respectively. This arrangement can give multitool 120*a* twelve different wrench sizes to used. Folding multitool 120*a* is shown assembled and pivoted to its stowed position, and has substantially the same structure as multitool 120 with the exception that the side hinge defined by hinge pin 128*a* has been widened to pivotally attach two tool arms 131*a* and 132*a*. Multitool 120*a* can comprise a central hub 130*a*, a smallest duplex wrench head 121 (tool head) attached to pivotal arm 131*a*, a small duplex wrench head 122 attached to a pivotal arm 132*a*, a third largest duplex wrench head 123 attached to tool arm 133, a fourth largest wrench head 124 attached to tool arm 134, a fifth largest duplex wrench head 125 attached to a tool arm 135 and a largest duplex wrench head 126 attached to tool arm 136. In FIG. 4A, multitool 120*a* is shown in its fully stowed position.

In FIG. 4A-B, central hub 130*a* is shown comprising a hinge paw 137 and a side hinge paw 137*a*. Hinge paw 137 is designed to accept hinge pins 138 and 139 similar to hinge paw 137 and provide two folding hinges for arms 133, 134, and 136. Hinge paw 137*a* is designed to accept hinge pin 128*a* to provide a folding hinge for arms 131*a* and 132*a*. Tool arm 135 can be securely attached to central hub 130*a* so that it cannot pivot with respect to central hub 130*a*. Tool arms 131*a*, 132*a*, 133, 134, and 136 are pivotally attached to central hub 130*a*. Tool arms 131*a* and 132*a* can be pivotally attached to hinge paw 137*a* with hinge pin 128*a*. Hinge pin 128*a* can be longer than hinge pin 128 to provide room for the additional tool arm. Arms 133 and 134 can be pivotally attached to hinge paw 137 with hinge pin 138. Arm 136 can be pivotally attached to the lower portion of hinge paw 137 with hinge pin 139.

In FIG. 4B, friction washers 138*a* and 138*c* can be similar to friction spring washer 138*b* to provide internal friction between the tool arms in this example and central hub 130*a*. Friction washer 138*a* forces arms 131*a*, 132*a*, and the surfaces of hinge paw 137*a* together to provide pivotal friction for arms 131*a* and 132*a*. Friction washer 138*b* forces arms 133, 134, and the surfaces of hinge paw 137 together to provide pivotal friction forces for tool arms 133 and 134. Friction washer 138*c* forces arm 136 against the surfaces of hinge paw 137 together to provide pivotal friction for holding tool arm 136 in place during use. To keep the drawings readable and uncluttered, many of the examples in this patent do not show any friction creating devices, but many prior art friction and locking mechanisms can easily be incorporated with any of the disclosed pivotal tool arm hinges. A locking mechanism can be used in combination with a friction force mechanism or by itself to alternately release and lock the tool arms in a particular orientation for use. This ability to lock a tool arm in place is useful in many situations, and many prior art methods exist for providing this kind of temporary locking mechanism on tool arms, such as, hinges on ratchet heads, wrench pivot joints, swivel joints, etc.

In FIG. 4C we see folding multitool 120*b* in perspective view. Multitool 120*b* has nearly the same construction as multitool 120*a* except that wrench head 126, arm 136 and central hub 130*a* have been replaced with reversible ratchet head 140 and tool arm 146, and central hub 130*a*, respectively. Central hub 130*b* is only slightly modified compared to central hub 130*a*, with hinge paw 137*b* nearly identical to hinge paw 137*a*, but shifted to the back portion of hub 137*b* to show an alternate positioning. Arms 131*b* and 132*b* can also be slightly modified versions of arms 131*a* and 132*a*, respectively. The wrench head sizes have been left the same as seen in multitool 120*a*.

In FIG. 4C, multitool 120*b* comprises a central hub 130*b*, a smallest duplex wrench head 121 attached to pivotal arm 131*b*, a small duplex wrench head 122 attached to a pivotal arm 132*b*, a third largest duplex wrench head 123 attached to tool arm 133, a fourth largest wrench head 124 attached to tool arm 134, a fifth largest duplex wrench head 125 attached to a tool arm 135 and a reversible ratchet head 140 attached to tool arm 146. Ratchet head 140 can comprise a ⅜ inch socket connector 145 and a swivel hinge pin 144 to allow it to pivot as shown by pivot range 129*c*. Tool arms 131*b* and 132*b* can be the same as tool arms 131*a* and 132*a* seen in multitool 120*a*, respectively, but are shown here straighter at the hinged ends of each arm to accommodate the different relative location of hinge pin 128*b* on hub 130*b*. Multitool 120*b* is shown comprising five wrench tool arms 131*b*, 132*b*, 133, 134, and 135 each with a duplex wrench head 121, 122, 123, 124, and 125 mounted on it, respectively, and a sixth tool arm 146 with a reversible ratchet head 140 mounted pivotally to arm 146 with hinge pin 144. A locking mechanism 144*a* is designed to have multiple locking or sticking positions that can hold ratchet head 140 in a particular angle with respect to arm 146 during use. Locking mechanism 144*a* can comprise any of a number of prior art hinge locking or friction creating mechanisms. In some designs the locking mechanism can be built into hinge pin 144. This arrangement can give multitool 120*b* ten different wrench sizes to used, plus a locking reversible ratchet wrench. Each tool head and arm combination can be made from a single piece of material such as carbon steel, tool steel, chrome vanadium steel, stainless steel, titanium, etc., depending on what it will be used for.

In FIG. 4C, central hub 130*b* is shown comprising a hinge paw 137 and a side hinge paw 137*b*. Hinge paw 137 is designed to accept hinge pins 138 and 139 and provide two folding hinges for arms 133, 134, and 136. Hinge paw 137*b* is designed to accept hinge pin 128*b* to provide a folding hinge for arms 131*b* and 132*b*. Tool arm 135 can be securely attached to central hub 130*b* so that it cannot pivot with respect to central hub 130*b*. Tool arms 131*a*, 132*a*, 133, 134, and 136 can pivotally attached to central hub 130*b*. Tool arms 131*b* and 132*b* can be pivotally attached to hinge paw 137*b* with hinge pin 128*b*. Hinge pin 128*b* can be longer than hinge pin 128 to provide room for the additional tool arm. Arms 133 and 134 can be pivotally attached to hinge paw 137 with hinge pin 138. Arm 136 can be pivotally attached to the lower portion of hinge paw 137 with hinge pin 139.

In FIG. 4C, each tool arm can be pivotally attached to hub 130*b*. Wrench head 125 and arm 135 can be fixed to central hub 130*b* so that it cannot pivot, or be mounted pivotally with a hinge that is parallel to hinge pins 138 and 139. If a folding hinge is used with center arm 135, then hub 130*b* should be designed to provide a pivot stop for arm 146 to prevent it from rotating significantly more clockwise than its position shown in FIG. 4C. This will allow arm 146 to provide torque in one direction to side arms 131*b* and 132*b* to turn a fastener with wrench heads 121 and 122. Similarly, if a folding hinge is used with center arm 135, then hub 130*b* should be designed to provide a pivot stop for arms 133 and/or 134 to prevent them from rotating significantly more counter-clockwise than their position shown in FIG. 4C. This will allow arms 133 and/or 134 to provide torque in the opposite direction to side tool arms 131*b* and 132*b* and turn fasteners in the opposite direction with wrench heads 121 and 122. With these two pivot stops in place, the collection of arms 133, 134, 135 and 146 can be gripped like a handle and can be made to not significantly pivot as a whole with respect to central hub 130*b*. Thus, this collection of tool arms can act like a handle that is securely attached to hub 130*b* even though all the arms can pivot through approximately one-hundred eighty degrees of arc. Because the folding hinges for tool arms 133, 134, 135 and 146 are parallel to each other (hinge pins substantially parallel) each of these arms can transfer torque to another without the need for a locking mechanism. If a locking mechanism is used on one or more of the larger tool arms then those arms can behave as if there was a stop on hub 130*b* to prevent them from pivoting and allow additional orientations of the tool arms that can apply useful torque to wrench heads 121 and 122.

In FIG. 4C, a socket extension 148 comprising a female socket connector 148*a* on one end and a male socket connector 148*b* on the other. Socket extension 148 is shown removably attached to socket connector end 145 with female connector 148*a* and connected to sparkplug socket 147 with male socket connector 148*b*. Ratchet head 140, socket 147 and extension 148 can be of a standard design that can be found in most hardware stores. This provides multitool 120*b* with the ability to remove a sparkplug from most cars made today while at the same time allowing other sized sockets and extensions to be attached and used with ratchet wrench 140 if needed. In this particular design, all the wrench heads (121, 122, 123, 124, and 125) and all the tool arms (131*b*, 132*b*, 133, 134, and 135) are arranged so that ratchet head 140 can be pivoted around swivel hinge pin 144 to a stowed position 140*q* (shown in shadow lines) along with extension 148 (stowed position 148*q* shown in shadow lines) and socket 147 (stowed position 147*q* shown in shadow lines) while still attached. Thus, the arrangement of tools in multitool 120*b*, is such, that socket extension 148 and sparkplug socket 147 can remain attached to the multitool even when stowed. Notice that extension 148 when pivoted to its stowed position 148*q* is substantially adjacent to arm 135 and wrench heads 121 and 123. Similarly, sparkplug socket 147, when pivoted to its stowed position 147*q* is substantially adjacent arms 131*b*, 133, and 135, and t wrench heads 121. This forms a very compact stowed position even with socket 147 and extension 148 still attached. Notice also that the stowed positions 147*q* and 148*q* place the longitudinal axis of socket 147 and extension 148 substantially parallel to the longitudinal axis of the other tool arms 131*b*, 132*b*, 133, 134, 135, and 146 when multitool 120*b* is in its stowed position. In alternate designs, center arm 135 and wrench head 125 might be replaced with screwdriver arm 158 (center arm) and screwdriver assembly 155 (see FIG. 7A-B) to make the multitool more functional for use on a motor vehicle. In fact, such a multitool might only provide wrench sizes for that specific model of vehicle, so that the majority of tools to work on that particular vehicle are all incorporated into a single multitool that can fit in the owners pocket when stowed.

In all the multitool examples presented in this patent, each pivotal arm and tool combination can be substituted for each other to customize a multitool for a specific set of tools. Because all the tools can be attached to a central hub with hinges, each tool, along with its tool arm, can be simply substituted in most cases by removing its hinge pin and installing it on another central hub. In some configurations or arrangement of tools, the shape of the tool arms and/or tool heads might need to be modified to allow all the tool heads and tool arms to fold up into a compact pocket-ready stowed position. This can allow multitool 120*b* to be modified into a very large number of configurations including a configuration for a specific automobile. For example, if tool arm 135 and wrench head 125 are replaced with screwdriver assembly 155, multitool 120*b* would still have eight wrench that could be configured to the sizes on a specific automobile. Ratchet wrench 140 could still be used with sparkplug remover socket 147, and an additional paw hinge similar to paw hinge 137*d* and folding hinge pin 128*d* (see FIG. 5A) could be added to central hub 130*b*. With this additional paw hinge one, two, or more additional tools specific to that automobile can be added to the multitool. These added tools might comprise any of a number of tools common to the vehicle in which this modified multitool would be used. Further, the sharp corner 149 on hinge paw 137*b* can also provide a very effective automotive glass breaking tool for emergencies. Thus, the reader should understand that the examples presented in this patent are only a small selection of the possible tool configurations for the disclosed invention.

In FIG. 4C, folding multitool 120*b* is shown with ratchet wrench head 140 pivoted for use in a short handle position. In this shown position, the attached socket extension 148 and sparkplug socket 147 can be used by gripping tool arms 131*b*, 132*b*, 133, 134, 135, and 146 as the handle to turn socket 147. If more torque is needed, arm 146 can be rotated to an extended position, along with extension 148 and socket 147, by rotating arm 146 one-hundred eighty degrees counter-clockwise to the right side in the drawing. In this extended position, tool arms 131*b*, 132*b*, 133, 134, and 135 become an extended handle for arm 146 and ratchet 140 to provide a long handle position for arm 146 and provide maximum torque to ratchet head 140. Notice that ratchet head 140 can be considered a second central hub where extension 148 is its non pivotal center arm and arm 146 is one of its folding arms. Thus, the reader should understand that the single central hub examples shown in this patent can be combined by attaching the folding arm of one central hub to the folding arm of another central hub as shown here. Alternate configurations comprise attaching the center arm of one central hub to the center arm of another central hub, or attaching the central arm of one central hub to the folding arm of another central hub. This attaching of central hubs together can be useful for tool heads that have a wide profile so that their relatively thin arms can fold in both directions to intermesh the wider tools more compactly for stowage. Such configurations provide, as they do in multitool 120*b*, the ability for a particular tool to incorporate a tool extension (tool arm used longitudinally) along with the option for both a short handle configuration and a long handle configuration. This is particularly useful for socket wrenches where a particular socket (sparkplug socket 147) requires an extension (extension 148) to reach its rotary fastener (sparkplug), but also requires an extended handle (arm 146 plus arms 133, 134, and/or 135 as an extended handle) to provide sufficient torque to loosen or tighten that rotary fastener.

In FIGS. 5A-B, we see a multitool 120*c* in perspective view and end view, respectively. Multitool 120*c* is similar to multitool 120*b*, with a slightly modified central hub 130*c*, a tool arm 136*c* with a crescent style adjustable wrench head 126*c* (tool head) replacing ratchet tool arm 146 and ratchet head 140, respectively, and tool arm 154*f* and a ratcheting wrench head 154 replacing arm 134 and wrench head 124, respectively. Other minor changes comprise side paw hinge 137*c* being placed more centrally on central hub 130*c* than in either hub 130*a* or 130*b*, and arms 131*c* and 132*c* slightly modified to fit the new positioning of their hinge pin 128*c*. Multitool 120*c* also comprises additional hinge paw 137*d* with tool arms 141 and 142 attached with hinge pin 128*d* (see wrenches in gap between arms 133 and 154*f* in FIG. 5A, see FIGS. 5B and 6A for clearer view of arm 141 with attached duplex wrench head 141*a*, and arm 142 with duplex wrench head 142*a*). In FIG. 5A, multiwrench 120*c* is shown in a substantially stowed position, but can be placed in its fully stowed position by folding tool arm 154*f* and tool head 154 against center arm 135. The pivot range of arms 133 and 154*f* is shown by arrows 159.

In FIG. 5A-B, multiwrench 120*c* (multitool with only wrench tools) comprises a central hub 130*c*, a smallest duplex wrench head 121 attached to pivotal arm 131*c*, a small duplex wrench head 122 attached to a pivotal arm 132*c*, a third largest duplex wrench head 123 attached to tool arm 133, a second largest reversible ratchet wrench head 154 attached to tool arm 154*f*, a largest duplex wrench head 125 attached to a tool arm 135 and a crescent wrench head 126*c* attached to tool arm 136*c*. Central hub 130*c* can comprise a hinge paw 137, a side hinge paw 137*c* and a second side hinge paw 137*d*. Hinge paw 137 is designed to accept hinge pins 138 and 139 and provide two folding hinges for arms 133, 134, and 136. Hinge paw 137*c* is designed to accept hinge pin 128*c* to provide a folding hinge for arms 131*c* and 132*c*. Hinge paw 137*d* is designed to accept hinge pin 128*d* to provide a folding hinge for arms 141 and 142 (see FIG. 5B). Center arm 135 can be securely fastened to hub 130*c* so that arm 135 cannot pivot with respect to hub 130*c*. Tool arms 131*c* and 132*c* can be the same as tool arms 131*b* and 132*b* seen in multitool 120*b*, respectively, but can be shaped differently at the hinged ends of each arm to accommodate the different relative location of hinge pin 128*c* on hub 130*c*. Tool arms 131*c* and 132*c* can be attached to hub 130*c* with hinge pin 128*c*. Crescent wrench head 126*c* can comprise a standard crescent wrench design with arm 136*c* pivotally attached to hub 130*c* with folding hinge pin 139 (see FIG. 5B). This arrangement can give multitool 120*c* fourteen different wrench sizes (seven duplex box end wrenches) to used (two wrench heads 141*a* and 142*a* not marked—see FIG. 6A), plus an adjustable crescent wrench head 126*c*. Each pivotal tool arm 131*c*, 132*c*, 133, 136*c*, 154*f*, 141, and 142 can rotate approximately one-hundred eighty degrees to point their longitudinal axis to the right for use (see extended positions 131*q* and 141*q*, for tool arms 131*c* and 141, respectively, shown in shadow lines in FIG. 5A). Each tool head and arm combination can be made from a single piece of material such as carbon steel, tool steel, chrome vanadium steel, stainless steel, titanium, etc., depending on what it will be used for.

In FIG. 5A, we see wrench head 154 comprising a ratchet housing 154*a*, a ratchet hub 154*b* (also called a ratchet head or ratchet wheel), a selectable ratchet mechanism 154*c* (reversible ratchet mechanism), a wrench head swivel arm 154*d*, and a wrench head swivel hinge pin 154*e*. Wrench head 154 is pivotally attached to tool arm 154*f* with hinge pin 154*e*. Ratchet housing 154*a* is mounted on swivel arm 154*d* with ratchet mechanism 154*c* mounted within swivel arm 154*d* to allow reversible ratchet motion of ratchet hub 154*b*. Wrench ratchet hub 154*b* defines a flat duplex wrench pair (different wrench size on each side) that normally have their gripping surface axes substantially inline. Ratchet mechanism 154*c* allows ratchet action of ratchet hub 154*b* in either direction within housing 154*a* depending on the position selected for ratchet mechanism 154*c*. The internal ratchet mechanisms is not shown for ratchet mechanism 154*c*, but many different ratchet mechanisms are commonly used and many more exist in the prior art which can be used for ratchet mechanism 154*c* with many variations possible. Hinge pin 154*e* pivotally connects tool arm 154*f* to swivel arm 154*d*. Wrench head swivel arm 154*d* is kept short to allow easier positioning of wrench head 154. An alternative designs the hinge at hinge pin 154*e* can be reversed, with the hinge paw portion placed on tool arm 154*f* and the hinge post portion placed on swivel arm 154*d*. This can be used to reduce the size and length of swivel arm 154*d*. The combination of housing 154*a*, hub 154*b*, ratchet mechanism 154*c*, and swivel arm 154*d* can pivot around hinge pin 154*e* to allow wrench head 154 to be angled as needed to get to specific rotary fasteners with both sides of the wrench. The hinge at pin 154*e* can include a friction system and/or locking system if desired (see washer springs in FIGS. 1A-B, 2A, 3C and 4B, and locking mechanism 144*a* in FIG. 4C) to maintain a particular angle for swivel arm 154*d* during use. As seen in FIG. 4B, the other arm hinges can also include friction spring washers if desired.

In FIG. 5B, we see a right end view of multiwrench 120*c* with wrench heads removed to make the drawing uncluttered. Notice that the positioning of hinge paws 137, 137*c*, and 137*d* can be adjusted for specific configurations and types of tool arms used. In this particular example, tool arm 135 might be made narrower at central hub 130*c* so that hinge paws 137*c* and 137*d* can be pulled in closer to the center of hub 130*c* and thus make the width of hub 130*c* narrower than shown. Similarly, many variations for the hinges are possible. In FIGS. 6*b* and 6C, two additional examples for hinge placement are shown with various angles that can be used for the hinges. Alternatively, additional arms can be added to a particular hinge by making it wider. This is especially easily to do if smaller wrench sizes are added since smaller wrenches can have smaller forces on them, so their arm hinges can be made relatively narrow compared with the other larger wrenches. Thus, the hinges for the smaller tool arms 141 and 142 can be much narrower than the other tool arms.

In FIG. 6A, we see a multitool 120*d* in perspective view to demonstrate how various tools can be swapped out to provide the desired tool combination and also how different angles for the hinges can be used. Central hub 130*d* is nearly identical to hub 130*c* except two angled side hinge paws 137*e* and 137*f* are used instead of single hinge paw 137*c*. Multitool 120*d* can be very similar to multitool 120*c*, with duplex wrench head 124 and arm 134 replacing ratcheting duplex wrench head 154 and arm 154*f*, respectively, and with a hammer head 151 (and claw 152) on an center hammer arm 153 replacing duplex wrench head 125 and tool arm 135, respectively, and with wrench head 125 and arm 136 replacing crescent wrench head 126*c* and arm 136*c*, respectively.

In FIG. 6A, multitool 120*d* is shown comprising a central hub 130*d* with a plurality of tools attached to it that are pivotal to a compact stowed position. Central hub 130*d* comprises a double hinge paw 137, two single hinge paw 137*e* and 137*f* on the front-side and one single hinge paw 137*d* on the back-side. Pivotal arms 131*c*, 132*c*, 133, 134, 141 & 142, and 136 and their respective duplex wrench heads 121, 122, 123, 124, 141*a*, 142*a*, and 125 have been discussed previously and are pivotally attach to hub 130*d* with hinge pins 128*e*, 128*f*, 138, 138, 128*d*, 128*d*, and 139, respectively. Wrench heads 141*a* and 142*a* are shown in FIG. 6A attached to arms 141 and 142, respectively. Wrench heads 141*a* and 142*a* were partially seen in FIG. 5A between arms 133 and 154*f*, but were not labeled for lack of room. Both arms 141 and 142 are pivotally mounted to hinge paw 137*d* with hinge pin 128*d*. Wrench head 125 has been placed on a longer tool arm 136 just for variety, but could be just as easily placed on the center arm as seen in FIGS. 5A-B with arm 135. The designation here of arm 136 is used to show that different wrench heads can be placed on different length arms if desired. Note that arm 136 is also shown attached to duplex wrench head 126 in FIGS. 3A through 4C. In alternate configurations the tool heads (e.g., wrench heads, hammer head, etc.) can comprise a separate part from the tool arms, with the tool heads able to attach and detatch from each of the tool arms as desired. In alternate designs, hammer head 151 with claw 152 could be mounted on arm 136 and duplex wrench head 125 mounted on center arm 153, for example.

In FIG. 6B we see a right-end view of multitool 120*d* showing how the arms are arranged on central hub 130*d*. Arms 133 and 134 are pivotally mounted on horizontal hinge pin 138 to provide a pivotal axis for those arms. Arms 141 and 142 are pivotally mounted on vertical hinge pin 128*d*. Arms 131*c* and 132*c* are pivotally mounted on diagonal hinge pins 128*e* and 128*f*, respectively. And arm 136 is pivotally mounted on horizontal hinge pin 139. Hinge pins 128*e-f* are shown angled at about forty-five degrees from the vertical and horizontal. Other angles are possible, but angles near forty-five degrees allow the hinge pins to easily be installed in a compact arrangement of hinges. For example, hinge pin 128*e* is unobstructed from being inserted into hinge paw 137*e* from the lower left. Similarly, hinge pin 128*f* is unobstructed from being inserted into hinge paw 137*f* from the upper left. For hinge pins (pivot pins) that are angled significantly closer to vertical, the hinge pins may need to be inserted from above and below into the hinge paws. One of the advantages of having diagonally angled hinges is that it can produce a smoother contour for the central hub making it appear smaller in size.

In FIG. 6C, we see an right-end view of multitool 120*e* which is also seen in perspective view in FIG. 7A. In this design, each side-mounted arm hinge is angled on the diagonal. In FIG. 6C central hub 130*e* is shown with all its side hinges angled at approximately forty-five degrees from the horizontal. Tool arms 131*c*, 133, 141, and 142, and their respective wrench heads 121, 123, 141*a*, and 142*a*, respectively, can be identical to the same wrenches seen in multitools 120*d*. The other arms have been replaced with different or modified tools and arms from those seen in multitool 120*d*. The new tools comprise, pivotal socket wrench 170 on arm 174, overlapped and duplexed wrench head 124*e* on arm 134*e*, overlapped duplex wrench head 126*e* (tool head) on arm 136*e*, and four-bit screwdriver 155 on arm 158. An additional tool arm 143 is also added, and mounted on the top of tool arm 134*e* with hinge paw 137*i* and hinge pin 128*i*. Hinge paw 137*i* can be welded, drop forged, attached and/or formed by other methods on arm 134*e*. Arms 133 and 134*e* are pivotally mounted to horizontal hinge pin 138. Arms 141 and 142 are pivotally mounted on diagonal hinge pins 128*g* and 128*h*, respectively. Arms 131*c* and 174 are pivotally mounted on diagonal hinge pins 128*e* and 128*f*, respectively. And arm 136*e* is pivotally mounted on horizontal hinge pin 139. Screwdriver center arm 158 is attached directly to central hub 130*e* and does not pivot or rotate with respect to hub 130*e*. Note that tool arm 143 is mounted directly to arm 134*e* and must pivot with arm 134*e* during use. Thus, arm 143 and its attached wrench head 143*a* must be small enough that it does not significantly interfere with the operation of wrench head 124*e* and tool arm 134*e*. In alternate designs small tool arm 143 and its wrench head 143*a* might be designed to fold into an indentation in arm 134*e* or in another large tool arm (e.g., arm 136*e*). With arm 143 placed on the exterior of multitool 120*e* it can be pivoted to an extended position by itself for use, and with arm 134*e* when wrench head 124*e* is extended and being used.

In FIGS. 6C and 7A, hinge pins 128*e-h* are shown angled at about forty-five degrees from the vertical and horizontal. Other angles are possible, but angles near forty-five degrees provide a nice curve to the sides of the central hub and also allow the hinge pins to be easily be installed in a compact hinge arrangement. Hinge pin 128*e* is unobstructed from being inserted into hinge paw 137*e* from the lower left (see FIG. 6C) because hinge paw 137*f* is angled sufficiently to be out of the way. Similarly, hinge pin 128*f* is unobstructed from being inserted into hinge paw 137*f* from the upper left because hinge paw 137*e* is angled out of the way. Hinge paws 137*g* and 137*h* are angled similarly, but are slightly smaller in sized for the smaller tool arms 141 and 142, respectively. The side hinge paws shown are only examples and nearly any axis angle can be used, including pivot axes that are parallel to hinges 138 and 139. However, one of the advantages of having diagonally angled hinges is that they produce a rounded and compact central hub making it appear smaller in size.

FIG. 7A also shows that many other tools which can be incorporated into the basic multitool design. Multitool 120*e* comprises central hub 130*e* supporting nine tool arms, one with a screwdriver 155, one with a double ended socket wrench 170, and seven with multi-sized wrench heads providing eighteen wrench sizes (i.e., enough for both metric and standard sets). Screwdriver 155 can comprise a reversible screwdriver bit holder 156 that can comprise a standard hex-shaped ¼ inch deep socket on one end, and a standard hex-shaped 5/16 inch deep socket on the other end, as is common for this type of four-size screwdriver arrangement. Holder 156 locks in place in arm 158 when inserted in either direction. Wrench 170 comprises a double-ended elongated socket wrench head 173 pivotally attached to tool arm 174 at hinge paw 174*a*. Socket head 173 can pivot a full three-hundred sixty degrees as shown by line 179. Socket head 173 is being used here like a wrench head, but its large vertical height makes it also work like a socket which allows it to get down into indentations to reach rotary fasteners. Because of this large vertical dimension to socket wrench head 173, when it is being used, I will refer to this elongated wrench head as socket 173 from now on. The reader should note that the line is blurred between wrenches and sockets and the exact transition point is difficult to define. For example, duplexed wrench head 183 (see FIG. 9B) has a low vertical height so that it can get into tight places, while socket 173 has a high vertical height so it can get into deep indentations, somewhere between these two is the transition point between wrench and socket, but this exact point is hard to define. When reversible screwdriver holder 156 (socket sizes ¼ and 5/16 inch) is combined with socket wrench 170, a total of four socket sizes can be provided with this multitool design. A double ended ¼ inch screwdriver bit 157*a* can be inserted in the ¼ inch socket end of screwdriver holder 156, and a second double ended 5/16 inch screwdriver bit 157*b* (see FIGS. 7B and 9A) can be inserted in the 5/16 inch socket end of screwdriver holder 156. The screwdriver bits 157*a-b* are reversible to give the screwdriver four separate bits that can be use. Screwdriver 155 comprises screwdriver arm 158, screwdriver holder 156, and two double ended screwdriver bits 157*a-b* (see FIG. 7B showing bit 157*b* in hidden line). Screwdriver arm 158 is attached directly to central hub 130*e* so that arm 158 cannot pivot with respect to hub 130*e*. Screwdriver holder 156 is designed to removably attach to arm 158 in either direction. This allows holder 156 to be removed and reinserted in the opposite direction into arm 158. Holder 156 can be a standard design size with a ¼ inch hex socket on one end, and a 5/16 inch hex socket on the other end. Each end of holder 156 can hold a properly sized double ended screwdriver bit similar to screwdriver bits 157*a* and 157*b*, which can have a hex shaped shaft that is sized to fit its end of holder 156. The screwdriver bits 157*a-b* are removably attached to screwdriver holder 156 so they can be reversed to use both ends of the screwdriver bits. This arrangement of screwdriver arm 158, double ended screwdriver holder 156, and double ended screwdriver bits 157*a-b* is a common design for present day screwdrivers and provides four sizes and/or types of screwdriver bits (e.g., flat head, phillips, hexagon, star, security shapes, etc.).

In FIG. 7A, socket wrench 170 comprises a tool arm 174 with a hinge paw 174*a*, and a double ended socket 173 with pivot knobs 173*r* and two socket ends 173*a* and 173*b*. Pivot knobs 173*r* are defined on socket 173 and pivotally attach to the ends of hinge paw 174*a*, as shown, to allow socket 173 to pivot up to three-hundred sixty degrees for use. Alternatively, a smaller range of rotation can be used, if desired, and allow a narrower hinge paw 174*a* connected to the smaller side 173*b* of socket 173. Pivot knobs 173*r* can comprise a friction producing means and/or a locking means to help hold socket 173 in a particular position during use. Socket ends 173*a* and 173*b* can provide two different sizes of socket and/or two different gripping surface styles (e.g. hex head, 12-point standard, 12-point spline, etc.). The other pivotal sockets in this patent can have similar structure.

In FIG. 7A, arms 133 and 134*e* are pivotally attached to hub 130*e* on the upper portion of hinge paw 137 with hinge pin 138 (see FIG. 6C). Arm 143 is pivotally attached to the top of arm 134*e* with hinge paw 137*i* and hinge pin 128*i*. Arm 131*c* is pivotally attached to hub 130*e* with hinge paw 137*e* and hinge pin 128*e* and. Arm 174 is pivotally attached to hub 130*e* with hinge paw 137*f* and hinge pin 128*f*. Arm 136*e* is pivotally attached to hub 130*e* with the lower portion of hinge paw 137 and hinge pin 139. Arm 141 is pivotally attached to hub 130*e* with hinge paw 137*g* (see FIG. 6C) and hinge pin 128*g*. Arm 142 is pivotally attached to hub 130*e* with hinge paw 137*h* (see FIG. 6C) and hinge pin 128*h*. Arms 134*e* and 136*e* are attached to quad-wrench heads 124*e* and 126*e*, respectively, which each provides an overlapped and duplexed wrench head that can have four different wrench sizes. The two top gripping surfaces of quad-wrench head 126*e* are angled forward as shown by gripping surface axes 49*d* and 49*f*. Notice that these two gripping surfaces intersect with each other such that the full gripping surfaces would overlap if fully present. Instead, a portion of each gripping surface has been cut away to allow position the gripping surface's rotational axes 49*d-f* to be placed much closer together than would be possible with full individual wrenches. These double duplexed wrenches (overlapped and duplexed) can be angled away from their respective arm in the same way the two-size duplex wrench heads are angled (see FIG. 6A with gripping surface axes 49*d* and 49*e*). These angles are shown at approximately fifteen degrees away from perpendicular with respect to the tool arm, but other angles can be used.

In FIG. 7B we see multitool 120*f* with more examples of different tool configurations. Multitool 120*f* comprises a central hub 130*f*, six duplex box-end wrenches (arms 131*c*, 132*c*, 133, 134, 141 and 142, attached to duplex wrench heads 121, 122, 123, 124, 141*a*, and 142*a*, respectively), a four bit screwdriver 155, and a pair of pliers 160. In this arrangement, the pair of pliers 160 and screwdriver 155 is combined with a set of twelve wrench sizes (twice as many sizes are possible if quad-sized wrench heads are used.). Central hub 130*f* can be substantially the same as central hub 130*c* seen in FIGS. 5A-B, with the same arrangement of hinge paws 137, 137*c* and 137*d*. However, screwdriver 155 is attached directly to central hub 130*e* with arm 158 which is designed to receive reversible screwdriver bit holder 156 which supports double-ended screwdriver bits 157*a-b*, one on each end (screwdriver bit 157*b* shown in hidden lines). Bits 157*a-b* can be reversed to present the other end of the screwdriver bit. Bit ends can have different sizes or different styles (e.g., flat head, Philips head, etc.). Screwdriver holder 156 can be reversed to expose screwdriver bit 157*b* on the other end, which can have different sizes or styles than bit 157*a*. Arms 133 and 134 are pivotally attached to hub 130*f* with hinge pin 138 (see FIG. 5B) on the upper portion of hinge paw 137. Arms 131*c* and 132*c* are pivotally attached to hinge paw 137*c* with hinge pin 128*c*. Pliers 160 comprises a right plier arm handle 164 connected to left plier claw 163, a left plier arm handle 161 connected to right plier claw 162, and pivot hinge 165 that pivotally connects the two plier arms. Right plier arm 164 in this design is pivotally attached to the lower portion of hinge paw 137 with hinge pin 139 (see hub 130*f* in FIG. 8A). Arms 141 and 142 are pivotally attached to hinge paw 137*d* with hinge pin 128*d*. Each duplex wrench in this example can individually pivot one-hundred eighty degrees to the right-side of hub 130*f*, to an extended position for use. To use screwdriver 155, pliers 160 can be pivoted to the right and tool arms 131*c*, 132*c*, 133, 134, 141 and 142 can be used as a grip handle to turn hub 130*f* which turns screwdriver arm 158, holder 156 and driver bits 157*a-b*. If the screwdriver must get into a tighter spot, all the pivotal tool arms can be pivoted to the right-side of hub 130*f* and gripped as an extended handle to turn screwdriver 155. To use pliers 160, the user can remove screwdriver holder 156 from arm 158 so that the claw portions 162 and 163 of pliers 160 are exposed. Then, the tool arms surrounding the pliers right arm 164 can be used as one handle of the pliers and handle 161 can be used as the other handle. If more space is needed, arms 131*c* and 132*c* can be pivoted out of the way as can the other arms. And of course pliers 160 can be used simply by pivoting it around its hinge to the right side of hub 130*f* so that both arm handles 161 and 164 can be easily gripped by the user. The orientation and position of pliers 160, shown in FIG. 7B, is only meant to be an example of where a pair of pliers might be mounted and positioned on a multitool. The positioning of pliers 160 can depend on the other tools used in a particular configuration so that when all the tools are stowed, the multitool forms a compact pocket ready configuration. The tools and arms can also be put into more ergonomic configurations for use as the handle for the pliers. Multitool 120*f* is only one example of the ergonomic use of the tool arms to form a handle for a pair of pliers.

In FIGS. 7A and 7B, we see two multitools 120*e* and 120*f* in a substantially stowed position with longitudinally adjacent tool arms. These positions, however, are not their fully stowed position which is their most compact position (all pivotal arms folded as close to center arm 158 as possible). For example, in FIG. 7A, arms 174, 142, and 141 can be further pivoted so that they are very close to parallel with center arm 158, to provide a more compact and fully stowed configuration. Even though FIG. 7A does not show the fully stowed position, this stowed position is still within the definition of "longitudinally adjacent" tool arms. In FIG. 7A, arms 142 and 174 are angled at approximately twenty degrees (substantially parallel) to a central axis, which in this example can be along the longitudinal axis of center arm 158. Arm 141 is nearly exactly parallel to the central axis, but is folded in the opposite direction. However, the majority (greater than 50%) of arm 141 is lengthwise adjacent to the rest of the multitool and thus might be considered lengthwise adjacent. Thus, multitool 120*e* is on the verge of not being defined as stowed in FIG. 7A. In FIG. 7B, we have a similar situation, where arms 141, 142, and 161 are each about twenty degrees from parallel with a center axis (e.g., the longitudinal axis of arm 158 and screwdriver 155), but are still substantially adjacent the other arms. Thus, folding arms 141, 142, and 161 can be pivoted further toward center arm 158 can provide a fully stowed position.

At this point it should be obvious to one skilled in tool making how to modify the disclosed multitool with additional tool arms and tool heads to provide nearly any combination and configurations desired. It should also be obvious that different kinds of hinges can be used, and that many different prior art locking and/or friction creating mechanisms can be placed on any of the hinges desired. Thus, nearly any sturdy prior art hinge mechanism style can be used with the disclosed invention. To finish this discussion I will present a few more specific examples that I found interesting.

In FIG. 8A-C, we see a multitool in a partially exploded perspective view comprising portions of two previously discussed multitools 120*d* and 120*f*. In FIG. 8A multitools 120*d and 120*f comprise modified versions of multitools 120*d* and 120*f*, respectively. Multitool 120*d can be substantially identical to multitool 120***d*, but with arms 134, 141, and 142 removed, and folding arm 133 moved to hinge paw 137*d* so that wrench size 123 is included. Similarly, multitool 120*f can be substantially identical to multitool 120***f*, but with arms 131*c*, 132*c* and 133 removed and folding arm 134 moved to hinge paw 137*c* (seen in FIGS. 7B & 8C) so that wrench size 124 is included.

In FIG. 8A, the two multitools 120*d and 120*f are shown being assembled with a hinge connector assembly comprising hinged connector 167 with hinge holes 167*a* and 167*b*, two hinge pins 138, and two spring washers 87*a* and 87*b*. Hinged connector 167 is pivotally connected to both multitool 120*d and 120*f with the top portion of hinge paw 130*d-f* respectively. Two hinge pins 138 are used to pivotally connect hinge paw holes 138*d* on hinge hub 130*d* to hinge hole 167*a* on connector 167, and to pivotally connect hinge paw holes 138*d* on hinge hub 130*f* to hinge hole 167*b* on connector 167 (see the assembly paths in FIG. 8A). Thus, connector 167 acts as a double folding hinge for the shown assembly. Spring washers 87*a-b* are inserted one each on hinge pins 138 between hinged connector 167 and hinge paws 137 on each multitool 120*d and 120*f. The spring washers provide a holding force to resist multitools 120*d and 120*f from pivoting with respect to each other and help hold them in a particular position. In alternate designs, connector 167 can be integrated with one of the multitool's central hubs eliminating the extra parts and only requiring a single hinge pin 138 and spring washer 87*a* (with connector integrated with hub 1300 to connect the two multitools. In other alternative designs, multitools 120*d and 120*f can be pivotally connected with a hinge system that can be easily taken apart, so that each multitool can be used separately if desired. A separable hinge is not shown here (other than removing hinge pin 138), but could easily be incorporated into the hinge connector assembly by someone skilled in hinge design.

In FIG. 8B, we see an end view of multitool 120*d showing central hub 130***d* with hinge connector 167 attached with hinge pin 138, and the new pivotal arm arrangement. Multitool 120*f and the tool heads are not shown in this drawing to more clearly show the hub area of tool 120*d. Notice that central hub 130*d* can be identical to central hub 130*d* seen in FIGS. 6A-B, but with a different arrangement of tool arms.

In FIG. 8C, we see an end view of multitool 120*f showing central hub 130***f* with hinge connector 167 attached with hinge pin 138, and the new pivotal arm arrangement. Multitool 120*d and the tool heads are not shown in this drawing to more clearly show the hub area of tool 120*f. Notice that central hub 130*f* can be identical to central hub 130*f* seen in FIG. 5B, but with a different arrangement of tool arms.

In FIG. 9A, we see multitool 120*g* in perspective view, comprising a central hub 130*d*, screwdriver assembly 155 and a full set socket wrenches with nine socket sizes. Central hub 130*d* can be the same as in multitools 120*d*, but with screwdriver arm 158 attached to hinge hub 130*d* instead of hammer arm 153. Socket arm 182 can be pivotally attached to hinge paw 137*d* (see FIG. 6A-B) with hinge pin 128*d* at one end, and comprise a single-ended socket 181 mounted substantially inline (non-pivoting) with arm 182. Socket 181 has a gripping surface axis 48*d* that is substantially parallel to the longitudinal axis of its tool arm 182. Socket arm 172 can be pivotally attached to hinge paw 137*e* with hinge pin 128*e* at one end, and comprise an elongated hinge paw 172*a* with a double ended socket 171 pivotally attached at pivot knobs 171*r* on the other end. Socket arm 174 can be pivotally attached to hinge paw 137*f* with hinge pin 128*f* at one end, and comprise an elongated hinge paw 174*a* with a double ended socket 173 pivotally attached at pivot knobs 173*r* on the other end. Socket arm 176 can be pivotally attached to hinge paw 137 with hinge pin 138 (see FIGS. 6A-B) at one end, and comprise an elongated hinge paw 176*a* with a double ended socket 175 pivotally attached at pivot knobs 175*r* on the other end with a pivot range shown by line 179 (three-hundred sixty degree rotation). Socket arm 178 can be pivotally attached to hinge paw 137 with hinge pin 139 (see FIGS. 6A-B) at one end, and comprise an elongated hinge paw 178*a* with a double ended socket 177 pivotally attached at pivot knobs 177*r* on the other end. This arrangement allows each of the folding arms 172, 174, 176, 178 and 182 to pivot through an angle of approximately one-hundred eighty degrees, between a stowed position (e.g. arm position 174*q*) and a fully extended position (e.g. arm 174 as shown).

In FIG. 9A, each pivotal double ended socket 171, 173, 175 and 177 can be pivoted through a wide range of angles for use, and can have a three-hundred sixty-degree range of rotation. In FIG. 9A, socket 173 is shown with a gripping surface turning axis 48*c* (rotational axis) that is perpendicular to the shown longitudinal axis of arm 174. Rotating socket 173 ninety degrees can provide a gripping surface turning axis 47*a* that is substantially parallel (position 173*q*) to the longitudinal axis of arm 174. Thus, sockets 171, 173, 175, and 177 can be used in many angular positions. In this document, these pivotal sockets are shown with a pivot range 179 of three-hundred sixty degrees, but other smaller ranges of rotation can be used effectively. For stowage and screwdriver mode, each pivotal socket can be aligned with its tool arm as shown by sockets 171 and 173 in positions 171*q* and 173*q*, respectively, in shadow lines. Each pivotal socket 171, 173, 175, and 177 defines a pair of pivot knobs 171*r*, 173*r*, 175*r*, and 177*r*, respectively, on each side of their socket. These pivot knobs can be formed as part of its respective socket.

Alternatively, one or two hinge pins can be used to connect the pivotal socket to its respective elongated hinge paw to form the pivotal hinge for the socket.

In FIG. 9A, the arrangement of multitool 120*g* allows each of the pivotal sockets 171, 173, 175, 177 and 181 to be used in four different modes: 1) a screwdriver mode (see socket position 173*q* on extended arm 174) which may require a locking mechanism for the tool's, 2) a short handle mode with socket extension (see socket 181 with arm 182 acting as an extension and folding all other arms around screwdriver 155 for the handle), 3) a dual handle mode (see socket 181 on arm 182 using arm 174 as one handle, and the other pivotal arms stowed around screwdriver 155 as the other handle), and 4) a long handle mode (see socket 173 and arm 174 as shown with the other pivotal arms stowed around screwdriver 155 as the extended handle). These four operational modes can also be used with other multitool examples presented in this patent, but may require these tools' gripping surface axis to be pivotal between substantially parallel and substantially perpendicular orientations with respect to the longitudinal axis of its tool arm for such tools to access all these functions. If the sockets are fixed substantially parallel to the tool arm then only the screwdriver, short handle with extension, and double handle modes can be accessed without further modifications. If the sockets are fixed substantially perpendicular to the tool arm then only the long handle mode can be used without further modifications to this multitool. In FIG. 10, we will see how each of these modes plus a "long handle mode with extension" can be provided by simply elongating the central hub (a central hub at each end of a center handle).

In FIG. 9A, the "dual handle mode" is useful when the socket arm needs to be used as a socket extension and when greater torque is needed. One or both these useful features might be used for a particular situation. For example, if socket 175 were sized for removing automotive sparkplug, arm 176 can be used as a socket extension to reach down into the engine compartment to grip the sparkplug. If socket 175 and arm 176 are rotated clockwise ninety degrees from their position shown in FIG. 9A so that socket 175 and arm 176 are pointing to the left, then arm 174 and socket 173 can be grasped as one handle, and socket 177, arm 178 and screwdriver 155 can be gripped as a second handle (arms 172 and 182 can be folded against screwdriver 155 to be part of this second handle) to turn socket 175 along the longitudinal axis of arm 176. This forms a "T" shaped structure where the user can push and pull on the two handles created and apply torque to socket 175 through arm 176. Each of the sockets shown in multitool 120*g* can be used in a double handle mode by various configurations of the other arms and screwdriver positions to apply torque along the axis of that socket's tool arm.

In FIG. 9B, we see an alternative duplex wrench tool 180 designed for use with various multitools shown in this document. For example, duplex wrench tool 180 is designed as a replacement for socket tool 170 seen in FIGS. 9A and 10, and as a possible replacement for arm 132*a-c* in combination with duplex wrench head 122 seen in FIGS. 4A through 6B, 7B, 8A and 8B. Wrench tool 180 comprises a duplex wrench head 183 with a short swivel arm 183*a*, a tool arm 184, and a swivel hinge pin 185. Tool arm 184 comprises a hinge hole 184*r*, and a hinge paw 184*a*. Hinge hole 184*r* on tool arm 184 is designed to pivotally attach arm 184 to hinge paw 137*f* on central hub 130*d* (see FIGS. 6B and 9A) with hinge pin 128*f*, and pivotally attach to central hub 130*h* with hinge pin 188*b* (see FIG. 10). On the other end of tool arm 184, hinge paw 184*a* is designed to pivotally connect to swivel arm 183*a* of wrench head 183 with swivel hinge pin 185. For this particular design, wrench head 183 can rotate through an angle less than three hundred sixty degrees. In alternate designs, wrench head 183 can pivot a full three hundred sixty degrees by widening hinge paw 184*a* so that wrench head 183 can fit through. Swivel arm 183*a* and wrench head 183 can comprise the same piece of material or can be securely attached to each other. Wrench head 183 is a duplexed wrench head with two different sized gripping surfaces for turning rotary fasteners. These gripping surfaces that are substantially perpendicular to its hinge pin 185 and substantially parallel to each other in this particular design (see angled gripping surfaces on wrench head 125 in FIG. 5A). The gripping surfaces of wrench head 183 have been chosen to be the same size as the gripping surfaces on socket 173, so that multitool 120*g* would have similar functionality if wrench tool 180 where to replace socket wrench 170, though with some ergonomic differences. Because wrench 180 can be a replacement for socket wrench 170, wrench head 183 can have the same sized gripping surfaces as socket 173. In alternative designs, swivel arm 183*a* can be eliminated and wrench head 183 can be pivotally attached directly to an extended hinge paw 184*a*, similar to the construction of wrench 170, but with a truncated duplex wrench head 183 instead of double ended socket 173.

In FIG. 10, we see a perspective view of multitool 120*h*, comprising two central hubs 130*g* and 130*h* connected by a center arm 187, four folding tool arms 172, 174, 176, and 178, and four pivotal double ended sockets 171, 173, 175, and 177 (previously seen in FIG. 9A). Pivotal double ended sockets 171, 173, 175, and 177 are pivotally attached to tool arms 172, 174, 176, and 178, respectively. Central hubs 130*g* comprises two hinge paws in close proximity to each other with pivot pins 188*c* and 188*d* providing hinges for arms 176 and 178, respectively. Central hub 130*h* comprises two hinge paws in close proximity to each other with pivot pins 188*a* and 188*b* providing hinges for arms 172 and 174, respectively. Each of the central hubs 130*g* and 130*h* can have a pivot stop (see pivot stop 186 mounted at the outer end of central hub 130*g*) to prevent the tool arms from rotating significantly past one-hundred eighty degrees from their stowed position. In alternate designs, pivot stop 186 can be replaced with a screwdriver bit or screwdriver assembly that inserts into the end of center arm 187. In this way, multiple screwdriver sizes and function can be added to multitool 120*h* without significantly changing the structure of the central hub assembly. The screwdriver bits can be made to extend further away from the central hubs than shown by pivot stop 186, or can have a retracted position for stowage and an extended position for use. In this example, the pivotal axes of central hubs 130*g* and 130*h* are oriented substantially perpendicular to each other to allow the tools to fold on all sides of center arm 187 when stowed. This is especially useful when larger tools are used or when the tool end of the tool arms (see hinge paws 172*a*, 174*a*, 176*a* and 178*a*) are significantly wider or larger in diameter than the connecting portion of the tool arms (see arm portions of arms 172, 174, 176 and 178). In this design, the wider hinge paws 176*a* and 178*a*, and hinge paws 172*a* and 174*a* can be alternately folded from central hubs 130*g* and 130*h* to provide a more compact stowed position as shown in FIG. 10. The length of center arm 187 can be similar in length to tool arms 172, 174, 176, and 178, so that multitool 120*h* can tri-fold into a compact stowed position. Note that in FIG. 10, arms 172, 176, and 178 can be folded slightly further toward central hubs 130*g* and 130*h* to place multitool 120*h* in a more fully stowed position.

In FIG. 10, folding tool arm 172 comprises a hinge paw 172*a* for pivotally mounting socket 171 at one end, and is pivotally connected to central hub 130*h* with hinge pin 188*a* at the other end. Folding tool arm 174 comprises a hinge paw 174*a* for pivotally mounting socket 173 at one end, and is pivotally connected to central hub 130*h* with hinge pin 188*b* at the other end. Folding tool arm 176 comprises a hinge paw 176*a* for pivotally mounting socket 175 at one end, and is pivotally connected to central hub 130*g* with hinge pin 188*c* at the other end. Folding tool arm 178 comprises a hinge paw 178*a* for pivotally mounting socket 177 at one end, and is pivotally connected to central hub 130*g* with hinge pin 188*d* at the other end. Pivot stop 186 can be defined on each central hub 130*g-h* (only shown on hub 130*g*) and can be used to limit the range of rotation of the arms to approximately one-hundred eighty degrees and cause the arms to form a stiff handle when both tool arms are rotated to their extended position. For example, tool arms 176 and 178 can be rotated vertically in FIG. 10 until they rest against pivot stop 186. If stop 186 prevents further rotation of the arms before sockets 175 and 177 make contact, then the user can grip and squeeze arms 176 and 178 (and sockets 175, and 177, respectively) to apply force to both sides of stop 186. These forces on stop 186 can stabilize central hub 130*g* so that center arm 187 and tool arms 176, and 178 are held substantially fixed in relationship to each other during use. A similar arrangement can exist on central hub 130*h* with a second stop 186 (not seen) designed to similarly limit the rotation of arms 172 and 174. Thus, each socket tool can use the opposite tool arms as an extended handle for use. Notice that the socket tools can also be used in a short handle mode by pivoting the sockets for use. However, in this example, center arm 187 and hubs 130*g-h* force the tool arm being used away from center arm 187 because of its location with respect to the center arm. In alternate designs, tool arms 172, 174, 176 and 178 can be lengthened so that sockets 171, 173, 175 and 177 can pivot over the end of hubs 130*g-h* allowing the arms to remain closer together during use and providing a more ergonomic short handle mode. This modified tri-fold structure also provides two additional modes of operation to each of its tools: 1) an extended handle with a socket extension mode, and 2) a double extended handle mode.

In FIG. 10, multitool 120*h* can comprise various other tool designs besides socket wrenches shown here. For example, duplexed wrench head 122 fixed to wrench arm 132*c* (see FIGS. 6A-B and 8A-B) can be used to replace socket wrench 170 with similarly sized rotary fastener gripping surfaces. Alternatively, pivotal duplexed wrench 180 can also replace socket wrench 170 with similarly sized gripping surfaces, while providing a pivotal end on the wrench head. Of course the other socket wrenches can be similarly replaced to provide similar tools on the multitool. Many other tools and tool arm designs can be used with the basic central hub structure (central hubs 130*g-h* mounted at each end of center arm 187).

Operational Description (FIGS. 2B, 3A-C, 4A-C, 5A-B, 6A-B, 7A-B, 8A-C, 9A-B, & 10)

All the folding multitools presented in this patent can operate generally in the same way. The user pivots one or more pivotal tool arms and their tool head to the desired position for use, and uses one or more of the other tool heads and tool arms as an extended handle. Because of the multiple operational modes of some multitool designs operation can be more complicated than this, will be explained in the following sections in more detail.

Individual wrenches, with a single wrench size, can be used with the folding multitools presented in this patent and operate like a standard wrench once folded out for use. However, the multitool designs can be made more ergonomic by adding other tools to the multitool. If multi-size wrench heads are used, the multitool can be made even more compact because less tool arms are needed for the same number of wrench sizes. Multi-sized wrench heads operate slightly differently depending on their style and type, but are well understood. The actual act of using the wrench head amounts to nothing more than engaging a rotary fastener with the wrench's gripping surface for that size fastener and turning the wrench handle (i.e., tool arm), and is well understood by most people. However, the different modes and positions for the arms and wrench heads is less obvious and will be discussed further.

Along with the standard operation of the attached tools, each tool (tool arm and tool head combination) can be placed in any or all of the five functional positions: 1) all have a folded and stowed position, 2) many tools have a stowed position which is also an operational position, 3) some tool arms have a tool extension position, 4) some tools have a short handle operational position, 5) some tools can be used in a double handle configuration, 6) all tools have an extended handle position, and 7) all tools have an extended use position. This list does not include the fact that each of the pivoting arms can be rotated to a multitude of angles to provide many additional positions between each of these seven major functional positions or modes. For example, the tool arms might be angled at forty-five degrees to allow a wrench head to reach an awkwardly positioned bolt head. Normally this would require a specialty wrench, but because of the variety of angles possible, the folding multitools disclosed here can simulate a number of curved and strangely shaped wrenches and tools. The specific operation of the multitools depends greatly on the arrangement of tool arms and the placement of the folding hinges to allow the multitool to function in above mentioned positions. In many cases, the "extended handle position" can also be an "extended operational position". The "short handle position" is not available for some tools because some tools must be extended in order to use them because other tools are in the way (see screwdriver bit 157 in FIG. 7B). For this particular invention two separate hinge assemblies with two separate central hubs can be pivotally connected, with each central hub attached securely to a center handle (see FIGS. 8A-C). In this type of arrangement, a multitool can have more tool arms without increasing the size of individual central hubs. Such tools can also be designed to separate if desired so that each is easier to use. In any particular operation, when one tool head is being used, many or all of the other tool heads and tool arms can be folded back away from the tool being used and function as the handle for the multitool. Because of the pivotal nature of the tool arms, many different angle configurations can be created for the arms and tool heads. In this way, each tool arm and attached tool head has three basic functional modes (stowed, handle, and operational). Specific multitools can also have multiple positions for each of these three basic functional modes. Because of this, each of these functional modes will be discussed in the proceeding sections.

Tool Operation

The use of the wrench heads and other common hand tools discussed in this patent are somewhat common knowledge. For example, to use a wrench, the user simply places the wrench's gripping surface in contact with a rotary fastener's head and applies torque to the wrench's handle to turn the fastener. For other tools such as hammers, screwdrivers, pliers and others, most people intuitively know how to use these even if other pivotal arms are surrounding it in a stowed position. However, because of the multitude of possible configurations for the tool arms, a few specific examples will be discussed to ensure a sufficient understanding for someone in the tool industry to implement the full scope of this invention.

Stowed Positions (FIGS. 1C, 2B, 3A-C, 4A-C, 5A-B, 6A-B, 7A-B, 8A-C, 9A and 10)

One of the major advantages of the disclosed folding multitools are that they can be stowed in a compact, pocket ready form. The stowed position can minimize the overall size of the tool set by moving the arm substantially parallel to one another and/or moving the tools longitudinally adjacent one another, next to one another, and/or nested with one another. The multitool examples shown in this patent are shown mostly in their stowed positions, but someone skilled in engineering can optimize these configurations for storage size by making their stowed positions even more compact than shown. All of the multitool examples (FIGS. 3A through 9A) comprise a full set of wrenches or sockets (each example shows at least ten wrench sizes or ten socket sizes). This was done because of the great advantage of having a full set of wrench sizes permanently attached to each other so they cannot be individually lost. However, wrench sets are commonly sold with as little as six wrench and socket sizes, and these multitools can use smaller numbers of wrench sizes if desired. Further, the disclosed multitools do not have any wrenches or sockets for a particular tool arrangement, and other tools can take the place of wrenches or sockets in the disclosed examples.

In FIG. 1C, we see an example of multitool 60 in its stowed position. In this stowed position, each tool arm 52, 54*a*, and 62 are pivoted substantially parallel and lengthwise adjacent to one other arm, and tool heads 51, 55, and 61 are positioned substantially adjacent each other to form a compact shape. This arrangement can provide a very compact stowed position.

In FIG. 2A, we see how hinge pin 67 is assembled with hinge paw 68 and hinge post 65*a* to provide a pivotal axis 89*b* for pivotal tool arm 62. Similarly, hinge pin 87 is assembled with hinge paw 88 and hinge holes 53 and 83 to provide a pivotal axis 89*a* for pivotal tool arms 52 and 82.

In FIG. 2C, we see a similar example with multitool 90 in its stowed position, with each tool arm 52, 62, 82, 84, and 94 folded to a substantially parallel position and longitudinally adjacent to at least one of the other arm, and tool heads 51, 61, 81, 85, and 95 folded substantially adjacent each other. In other configurations the tool arms might be curved for ergonomic reasons and a compact stowed position can still be achieved by folding the arms substantially adjacent each other to occupy the minimum volume. The reader might notice that I am having a difficult time defining exactly what a compact stowed position is. Even though most people would be able to identify a stowed position, such a position is difficult to define in concrete terms. For example, an alternate way to define the stowed position is to define the stowed length as less than 70%, 65%, 60%, 55%, 50%, 45% and/or 40% of the multitools fully extended length. Another alternate definition of stowed can be where all the tool arms point in the same direction from the central hub and are substantially adjacent each other (longitudinally adjacent). Another definition of stowed might be a position where the multitool is less than five, six and/or seven inches long (maximum dimension). Another definition might be that the stowed position is where all the tools are folded so that they can touch at least one other tool (arm and/or tool head). Thus, it is not an easy task to completely define what a stowed multitool exactly is. However, sufficient examples are given in this patent that nearly anyone will understand what is meant by "stowed" and/or "pocket ready".

Most of the drawings in this patent show multitools substantially in their stowed position mainly because the stowed position takes up less space on the patent drawing sheets (another definition of stowed?). But, in FIGS. 4C, 5A, 6A, 7A-B, 8A, and 9A, at least some of the tool arms are pivoted away from their completely stowed position. For example, in FIG. 4C, ratchet arm 146 is in a substantially stowed position, but rachet head 140 is at a right angle so that socket extension 148 and socket 147 can be used in a short handle configuration (the other folded arms adjacent ratchet arm 146 being used as a short handle). The fully stowed position for ratchet 140, extension 148 and socket 147 is shown in shadow lines by rachet position 140*q*, extension position 148*q*, and socket position 147*q*. Another example is multiwrench 120*c* in FIG. 5A, which is shown substantially in its stowed position. However, tool arm 154*f* and wrench head 154 can still be folded against arm 135 and wrench head 125, to provide a more compact state, or more stowed state. Thus, the line between stowed and not stowed is a little fuzzy. I believe most people would say a multitool was not completely stowed if one of the arms was angled more than thirty degrees away from another tool arm. However, if only 20% of the arm's length is angled at thirty degrees away from the other arms and/or tools, then one might consider it substantially stowed. But if the entire arm is angled away from the other arms at thirty degrees, then the multitool might not be considered stowed, because of the difficulty one would have with placing it comfortably in their pocket, and the obvious reduction in size that could take place if that arm could be folded in that remaining thirty degrees. Thus, we might define a stowed position as having the entirety of each tool arm angled at less than thirty degrees away from any other tool arm. And the list could go on and on.

For the other examples of a stowed position, FIGS. 6A, 7A, and 7B, show multitools which are substantially stowed except for a few arms that are angled out way from the rest so they can be seen more clearly in the drawings. For example, in FIG. 6A, multitool 120*d* might be considered stowed, even though arms 141 and 142 can be pivoted against hammer arm 153 for a more compact stowed position. In FIG. 7A, socket 173 can be pivoted to an inline position 173*q*, and arm 174 pivoted against arm 136*e*, and arms 141 and 142 pivoted adjacent screwdriver arm 158 for a more compact stowed position. In FIG. 7B, pliers 160 can be closed further (claws 162 and 163 closed) so that arm 161 is moved more closely to arm 132*c* (adjacent arm 132*c*), and arms 141 and 142 pivoted in for a more compact stowed position.

In FIG. 8A, the two separate multitools are shown being assembled with an orientation one-hundred eighty degrees away from each other. After hub 130*d* and 130*f* are pivotally connected with connector 167, the two multitools 120*d and 120*f can be folded adjacent one another around hinge pins 138 to form a compact stowed tool. Plier handle 161 can again be pivoted inward toward hub 130*f* to make the multitool more compact.

In FIG. 9A, multitool 120*g* is shown with three tool arms 172, 174, and 182 either partially extended or fully extended for use. To put multitool 120*g* back in its fully stowed position sockets 171 and 173 can be pivoted parallel with their arms 172, and 174, respectively, and then arms 172, 174, and 182 can be pivoted substantially parallel and longitudinally adjacent screwdriver 155. Notice that socket 173 can be rotated to position 173*q* and arm 174 folded to position 174*q* to place that arm longitudinally adjacent to arms 176, 178, and 158. Thus all the tool arms are substantially parallel and point in the same direction when in their fully stowed position.

Stowed Operation

Many of the multitool designs disclosed in this patent can be used when in their stowed position. For example, adjustable wrench head 126*c*, seen in FIG. 5A, is exposed and ready for use in the substantially stowed position shown. In this position, tool arms 136*c*, 131*c*, 132*c*, 133, 135 and 154*f* act as a short handle for adjustable wrench head 126*c*. Similarly, in FIG. 6A, hammer head 151, can be used in its substantially stowed position with a short handle provided by the pivotal arms. Also, pliers 160 seen in FIG. 7B can be used in its stowed position, and used even more effectively if screwdriver holder 156 is removed. Also, screwdriver 155, in FIG. 9A, extends past socket heads 175 and 177 in their stowed position and thus can be used even when all the arms are folded against screwdriver 155. Also notice in FIG. 9A, that sockets 175 and 177 can be used in their stowed position if screwdriver holder 156 is removed. Finally, many of the fixed sized wrenches and sockets disclosed in this patent can be used while in their stowed position. For example, in FIG. 4A, duplex wrench heads 121, 122, 123, 124 and 125 have one exposed side that can be used when stowed, while wrench head 126 is positioned so that both its wrench sizes can be used when stowed. A similar situation occurs in FIG. 6A where both sizes of duplex wrench head 125 can be used while stowed as shown. Also, if the duplex and overlapped duplexed wrench heads are replaced with standard single-size wrench heads, then potentially all the wrench heads in a particular multitool could be used in their stowed position. Thus, operation of tools while stowed can give the user a short handle configuration that can provide a more convenient use of the multitool. In fact most of the example multitools disclosed here could be redesigned to use all their tools in their stowed position, by allowing easier access to each tool when in the stowed position. For example, in FIG. 7B, each duplex wrench head could be replaced with a standard single-size wrench head, and screwdriver 155 could be lengthened and/or plier handle 164 shortened to allow the use of all the tools on a modified multitool 120*f* in its stowed position.

Short Handle Operation

Many of the multitool designs disclosed in this patent can use some of their tools in a short handle mode. For example, in FIG. 5A, arm 154*f* can be pivoted substantially perpendicular to the other tool arms. Reversible ratchet wrench head 154 can further be pivoted at hinge pin 154*e* so that the axis of its gripping surfaces is substantially parallel with arm 154*f* (swivel arm 154*d* substantially perpendicular to arm 1541). In such a position, the other tool arms and tool heads can act as a short handle to turn arm 154*f* along its axis and turn ratchet hub 154*b* in either direction. Arm 154*f* in this situation would act as an extension for wrench head 154, allowing the wrench head 154 to reach into a deep depression to turn a rotary fastener. Similarly, in FIG. 9A, arm 182 and socket 181 can be used with arm 174 pivoted down against screwdriver 155 as shown by stowed position 174*q* in shadow lines. Then the user can grip the arms surrounding screwdriver 155 and use them as a short handle for socket 181 with arm 182 acting as a socket extension. Notice that all the pivotal tool arms on multitool 120*g*, In FIG. 9A, can be used in short handle mode with its arm acting as an extension, as well as the long handle configurations (see operational position of arm 174 and socket 173, and extended handle position of arms 158, 172, 176, and 178).

Long Handle Operational Position (FIGS. 1B through 9A)

All of the multitools disclosed in this patent can operate with a long handle position. Each tool can be extended while one or all the other tool arms are folded and used in a long handle position. This long handle configuration will in many cases be considered the "normal" operating position for that particular tool. For the folding multitools in this patent, each tool on a folding arm can be placed in its long handle operational position by starting in a stowed position and pivoting its tool arm to the opposite side of the central hub (see wrench head 121 in extended position 121*q*, in FIGS. 4A and 4C). For a tool mounted on a center arm (fixed to the central hub) the extended handle operational position is provided by pivoting all the other tool arms away from the center arm and collected them on the other side of the central hub. For multitools in FIGS. 1A through 2B, 3B, 4A, 4C, 5A, 6A, and 7A-B, this means the center arm tool remains on the left by itself, while the other tools are pivoted to the right side and used as an extended handle. From the stowed position of the multitool, extending a particular tool for use can cause the remaining tool arms to become part of an extended handle for the tool that was extended. For example, with multitool 120 in FIG. 3A, when wrench head 126 is pivoted to the left to extended position 126*q*, as shown in shadow lines, the remaining arms 132, 133, 134, and 135, along with their wrench heads 122, 123, 124, and 125, respectively, can be used as an extended handle for wrench head 126 and arm 136. Similarly, in FIG. 3B, the same multitool 120 can pivot wrench head 122 to extended position 122*q* for use, while the remaining tool arms 133, 134, 135, and 136, along with wrench heads 123, 124, 125, and 126 can be used as an extended handle for the operation of wrench head 122.

To use a center tool (on a center arm) with an extended handle, all or some of the folding tool arms can be pivoted to the opposite side of the central hub. For example, multitool 120*g* seen in FIG. 9A has a center arm screwdriver tool 155 which can be used in an extended operational position when all the pivotal arms are rotated vertically upward in the drawing (pivoted to opposite side of central hub 130*d*. Once arms 172, 174, 176, and 178 are collected on the opposite side of hub 130*d* they can be gripped by the user to use screwdriver 155. Because of its small size, arm 182 and its single size socket 181, can be left next to screwdriver 155 without significantly effecting the operation of the screwdriver. If the narrow size of the screwdriver arm 158 is needed to get into a tight spot, arm 182 can also be pivoted to the opposite side of hub 130*d* and collected with the other arms to be used as part of an extended handle.

For tools like a screwdriver, a stable handle (non-pivoting) is a big advantage, but some care should be taken to ensure that the central hub does not pivot too much when the tool arms are gripped for use as an extended handle. The multitools disclosed in this patent all have at least one folding hinge that is not parallel to the others. This provides two axes of stability for the central hub when the arms are pivoted together on the back-side (the opposite side) of the central hub for use of the center tool. For example, in FIG. 9A, if arms 172, 176, and 178 are pivoted to the other side of central hub 130*d* next to arm 174 (longitudinally adjacent), then because the pivotal axes of arms 172, 174, 176 are not parallel to each other each arm can prevent pivoting in a different direction. However, hinges generally have some play in them, so hub 130*d* might still be able to pivot five or ten degrees in either direction. This unstable nature of the central hub makes it more difficult to use a center tool like screwdriver 155. Luckily there are many ways to reduce this play between the central hub and the pivotal arms. For example, the arms' folding hinges can be made very tight so that there is very little play in them. Alternatively, the multitool designs presented in this patent can have a central hub that limits the pivot range of the arms to approximately one-hundred eighty degrees. This limiting of the pivoting range can be achieved by simply providing a stopping surface on the central hub, similar to stops 71 and 72 seen in FIG. 2C, to prevent rotation of the arms past a specific angle. If the central hub limits the pivot range of the arms to about one-hundred eighty degrees then the arms can be stopped from rotating further than approximately parallel with the longitudinal axis of the center arm. This can leave a space between the extended arms when they are pivoted to the opposite side of the central hub for use as a handle. This space allows the user to apply force to each arm, which in turn transfers force to the central hub in multiple directions. This combination of forces from multiple arms in multiple directions can stabilize the central hub by preventing it from rotating in any direction. Thus, when the pivoted arms are gripped, substantially all play can be eliminated between the pivotal arms and the central hub. For example, in FIG. 9A, if each arm was limited to approximately one-hundred eighty degrees of pivoting, then each arm could be stopped at approximately the vertically upward orientation (see vertically upward orientation of arm 174). The other arms can be designed to pivot upward and parallel (adjacent) arm 174, but not touching each other. When these arms that are extending vertically upward from central hub 130*d* are gripped by a user, forces are applied to hub 130*d* by arms 172, 174, 176, 178, and/or 182 in opposite directions to substantially prevent pivoting between the arms and the central hub. This limiting of the pivot angle for the folding hinges can be used on all the disclosed multitools to provide a stable extended gripping handle for each center tool.

In FIGS. 4A-C, we see central hubs 130*a* and 130*b* with substantially the same layout of tool arms (though slightly different tool arms). The extended operational positions for each are substantially the same for each multitool 120*a* and 120*b*. Extended operational position 121*q* (shown in shadow lines), for the smallest wrench head 121, can be seen in both FIGS. 4A and 4C. Similarly, wrench tool heads 122, 123, 124, 126 and 146 can be pivoted individually to the right (approximately one-hundred eighty degrees from the position shown) to be placed in their extended operational position. For center arm 135 with wrench tool head 125, its extended operational position is the same as shown, but with all the other tool arms pivoted to the right and adjacent one another, where all the pivoted arms become an extended handle for center arm 135 and tool head 125. All the other multitools operate substantially the same including possibly multitool seen in FIG. 8A, where two multitools 120*d and 120*f are shown that can pivot with respect to each other in addition to the pivoting of the arms.

In FIG. 8A, with both multitools 120*d and 120*f stowed (multitools 120*d and 120*f folded substantially adjacent each other and facing in the same direction) each pivotal tool arm can be folded out individually for use in its extended operational position. The center arm tools (hammer 150 and screwdriver 155) generally would require unfolding hinge connector 167 to be used and with the multitools extended as shown in FIG. 8A. For full use, one or more of the pivoting tool arms can be folded back from around the center tool to be used, leaving the center arm and tool ready for use. The collection of folded back arms can then be gripped to provide a long handle for that center arm tool. For example, tool arm 136 and wrench head 125 can be pivoted back away from hammer 150 leaving the hammer free to be used. Alternatively, each pivotal arm (arms 131*c*, 132*c*, 133, and 136) around hammer 150 can be pivoted back (to the right in drawing) to allow unobstructed use of hammer 150. Similarly, pliers 160 can be pivoted away from screwdriver 155 for use, or all the pivotal tool arms on multisocket 120*f can be pivoted to the left to provide unobstructed use of screwdriver 155**. In both cases the pivotal arms would provide a stable extended handle for the center arm tool being used.

In FIG. 10, each socket 171, 173, 175, and 177, can be used in long handle mode simply by folding out one of its tool arms 172, 174, 176, and 178, respectively, and pivoting that arm's socket ninety degrees so that the other arms and center connector arm 187 act as an extended handle for the extended socket.

Tool Extension Operation

Many of the tool arms on the disclosed multitools can also be used as a tool extension. When an arm is used as a tool extension, it allows the tool head to be extended into a narrow passage or deep well that the tool head could not reach by itself. The tool extension (sometimes called an extension bar for sockets) can work with a rotary fastener tool if the gripping surface of the rotary tool can be positioned substantially parallel to the axis of the tool arm (tool extension). Thus, for a tool arm to be an extension for a rotary fastener tool, the rotary axis of that gripping surface should be substantially parallel with the longitudinal axis of the tool arm (tool extension), or be able to rotate the gripping surface into a position that is substantially parallel to the longitudinal axis of the tool arm. Examples of both are discussed below.

In FIGS. 7A-B, 8A, and 9A, we see screwdriver 155, which has a gripping surface on screwdriver bit 157*a* that has a rotary axis that is substantially parallel to center arm 158. Thus, screwdriver 155 can extend down into a narrow passage or deep well when the other arms are pivoted back away from the screwdriver. In FIG. 7A, arm 136*e* and wrench head 126*e* can be pivoted at ninety degrees from screwdriver 155 so that they can be used as a short handle to turn screwdriver 155 around its longitudinal axis. The same arrangement can be used to turn fasteners with the two socket sizes on the ends of screwdriver holder 156 if the screwdriver bits 157*a-b* are removed (see FIG. 9A).

Double Handle Operation

The multitool examples seen in FIGS. 4C, 5A, 7A,7B, 8A, 9A, and 10 can be used in a double handle mode for providing higher torque to specific wrenches and sockets. In FIG. 4C, multitool 120*b* can be used in a double handle position by pivoting ratchet head 140 so that extension 148 and socket 147 are substantially parallel to ratchet arm 146. Then center arm 135 can be pivoted ninety degrees clockwise, forming one handle, and arms 133 and 134 pivoted another one-hundred eighty degrees to provide the second handle. Arms 131*b* and 132*b* can be pivoted with either side.

In FIG. 5A, tool arm 154*f* can be pivoted to be perpendicular to center arm 135 and wrench head 154 pivoted so that gripping surfaces (pointing vertical) axes are substantially parallel with arm 154*f*. Then arms 131*c*, 132*c*, 133, and 135 can provide one handle while adjustable wrench arm 136*c* can be pivoted one-hundred eighty degrees counter-clockwise to provide the second handle. With wrench ratchet hub 154*b* angled to place its wrench gripping surfaces parallel to the longitudinal axis of arm 154*f*, the two handles can provide torque down arm 154*f* and to ratchet wrench head 154 for use.

In FIGS. 7A-B, 8A, and 9A, screwdriver 155 can be used in double handle mode by simply pivoting any of the available arms to each side of the screwdriver. For example, in FIG. 7A, arms 133 and 134*e* might be pivoted ninety degrees clockwise to provide a one handle, and arm 136*e* pivoted ninety degrees counterclockwise to form a second handle. Also, in FIG. 7A, socket 173 and arm 174 can be pivoted perpendicular to center arm 158, and arm 136*e* pivoted one-hundred eighty degrees to the right side of central hub 130*e*. Then socket 173 can be used to turn a vertical fastener with large arm 136*e* providing one handle and all the other non-used tool arms providing the second handle.

In FIG. 9A, each tool on multitool 120*g* can be used in a double handle configuration, though for ergonomic operation, arms 172 and 174 could benefit from a locking mechanism because of their forty-five degree pivot angles, or be placed on a single hinge perpendicular to hinge paw 137. If both arms 172 and 174 were placed on the same hinge, and that hinge was perpendicular to the hinge on arm 176, then each tool could be used in a very stable double handle configuration. For example, screwdriver 155 can be used in a double handle position by pivoting arms 176 and 178 ninety degrees in opposite directions to form the two horizontal handles. These same two arm positions can also be used as a double handle to turn sockets 171, 173, and 181 when their respective arms are pivoted vertically in FIG. 9A (see socket position 173*q* at top of drawing). Socket 173 can also be used in a double handle mode by pivoting arms 176 and 178 one-hundred eighty degrees until they are close together above central hub 130*d*. Then with arm 174 pivoted horizontal (perpendicular to arms 176 and 178) then arms 176 and 178 can be used as one handle and arm 158 can be used as the second handle. To use socket 175, arm 176 can be pivoted ninety degrees to a horizontal position and arm 178 pivoted one-hundred eighty degrees to a vertical position. Then arm 158 can be used as one handle, and arm 178 used as the second handle. To use socket 177, arm 178 can be pivoted ninety degrees to a horizontal position and arm 176 pivoted one-hundred eighty degrees to a vertical position. Then arm 158 can be used as one handle, and arm 176 used as the second handle. This particular multitool has many additional ways of form a two handle position.

In FIG. 9B, wrench head 183 has a similar operating environment as ratchet wrench head 154 (see FIG. 5A) because they both can pivot their wrench head to different angles relative to their tool arm. Wrench 180 can be substituted for similar sized duplexed wrenches like pivotal wrench head 154 and arm 154*f*. In the design seen in FIG. 9B, swivel hinge pin 185 allows wrench head 183 to pivot through a range of angles 189 that can be significantly greater than one-hundred eighty degrees. One difference between socket 173 and wrench head 183 is the vertical height of the tool head. Socket 173 has a significant greater vertical height compared to its diameter than wrench head 183 which has a vertical height similar in size to its diameter. There is a smooth continuum of rotary fastener tool heights between a very flat wrench head and a very deep socket. The transition between a wrench head and a wrench socket is somewhere between these two extremes, but it is difficult to say exactly where it occurs. In practice, after the height of the wrench head extends more than its own diameter beyond the end of the handle it is connected to, it starts behaving more like a socket and less like a wrench as the height increases. This is by know means the best definitions of the difference between sockets and wrenches, but does provide a point that we might call a transition between wrench heads and socket heads.

Extended Handle with Tool Extension

In FIGS. 4C and 10, we see multitools 120*b* and 120*h*, respectively, that can provide an extended handle for the multitool while at the same time providing a tool extension (e.g., socket extension 148 in FIG. 4C). In FIG. 4C, multitool 120*b* provides an extended handle for rachet head 140 when arms 131*b*, 132*b*, 133, 134 and 135 are folded to the right to form an extended handle, while at the same time providing socket extension 148 for socket 147 to reach down into deep cavities that wrenches generally cannot fit. In FIG. 10, multitool 120*h* can provide an extended handle for each socket tool head where that socket tool head uses its tool arm as a tool extension. For example, in FIG. 10, if arms 176 and 178 are folded up to form an extended handle, both tool arm 172 with socket 171, and tool arm 174 with socket 173 can be alternately folded horizontal and used as a socket with a tool extension (the socket's tool arm 174 is the extension). Similarly, in FIG. 10, if arms 172 and 174 are folded down to form an extended handle, either tool arm 176 with socket 175, or tool arm 178 with socket 177 can be folded horizontal and used as a socket with an extension (the socket's tool arm). This allows each socket to get down into deep cavities while at the same time providing a long extended handle for applying torque to the socket.

Triple Length Extended Handle

In FIG. 10, we see multitool 120*h* with a tri-fold configuration that allows a triple length extended handle mode. Note that fixed socket 181 cannot be pivoted perpendicular to its own tool arm 182, and thus cannot be used for the third extension for its handle. However, the other pivotal sockets 171, 173, 175 and 177 can be used in triple length handle mode. The triple length handle mode can be used to provide maximum torque to the wrench socket when needed. For example, in FIG. 10, if arm 178 is pivoted to its extended position (vertically upward) around central hub 130*g*, and socket 177 is pivoted perpendicular to arm 178, then this configuration with arms 172, 174, and 176 pivoted together around center arm 187 provides a double length extended handle for turning socket 177. From this double length position, if then arms 172 and 174 on central hub 130*h* are folded to their extended positions (vertically downward in FIG. 10), they can act as an additionally extended handle so that multitool 120*h* acts as a triple length handle for providing maximum torque to socket 177. This triple length handle comes from the added lengths of arm 178, center arm 187 and arms 172 and 174 with their respective attached sockets 171 and 173. In another example, double ended socket 171 can be used by folding tool arms 176 and 178 upward to a vertical position to form a handle for the user, and arm 172 can be folded vertically downward to form an extended tool arm, and socket 171 can be pivoted substantially perpendicular to tool arm 172, so that socket 171 has a functional handle that is approximately three arm lengths long (arm 172, center arm 187, and combined arms 176 and 178). This type of folding seen in FIG. 10 can also allow multitool 120*h* to fold to less than fifty percent (50%) of its fully extended length (triple length). In this particular example, multitool 120*h* is shown folded to approximately thirty-eight percent (38%) of its fully extended length (triple length handle), and could be redesigned to fold to an even smaller percentage.

Notice that many of these multitools disclosed in this patent can benefit form the use of a locking mechanism on the pivotal arms to make it easier to use them in various positions (long handle, short handle, double handle, triple length handle, etc.). Also, because of the nature of a screwdriver, a locking mechanism may be desirable on some of the pivotal arms to help stabilize the screwdriver during use. Similarly, the other tools may also benefit from a locking mechanism on some or all of their pivotal arms.

While more detail could be provided on the operation of the disclosed examples, the above operational descriptions should be sufficient for most mechanically inclined people to understand how to use the disclosed multitools in their various operational and extended position.

Finally, the reader should understand that a patent of this length and complexity will have errors in it. For this reason, if a sentence within this document is not clear, or for some reason contradicts the rest of the specification or has some other error, that sentence can be deleted to correct the clarity of the patent.

Ramifications, and Scope

The disclosed folding multitool provides a full set of tools in a convenient folding multitool structure. The multitool is able to fold to a very compact state because the tool arms can also be used as an extended handle for the other tool arms, thus the weight of the collection of tools is often much less than half the weight of the same-sized collection of tool separately. For fixed sized wrench sets this weight can be nearly one-eighth as much as a complete standard set of similar sized wrenches. The disclosed multitool can have multiple hinges with axes oriented at various angles around the multitool, which allows nine, or more, tool arms each with one or more tools combined to form a single multitool.

Although the above description of the invention contains many specifications, these should not be viewed as limiting the scope of the invention. Instead, the above description should be considered illustrations of some of the presently preferred embodiments of this invention. For example, the first prototype multiwrench built using the disclosed technology was not even shown in the drawings simply because of the vast number of combinations that are possible. This first prototype comprised four duplex wrench heads each mounted on a reversible ratchet to provide a wrench structure nearly identical to reversible wrench 154, but without the swivel hinge pin 154*e* (tool arm 154*f* pivotally connected to swivel arm 154*d*). In this prototype, the largest tool arm was fixed to its central hub, and the other three tool arms were pivotally mounted around the central hub on three sides to form a very compact eight-size multiwrench (multitool). This type of prototype was built first simply because of the availability of the duplex wrench heads with reversible ratchets. Thus, it should be obvious from the above discussion that various kinds of wrench heads and wrench arm structures can be used, and be mixed and matched with other tools as needed. Standard style wrenches with single size wrench heads can be used with this invention because of the ability to have six or more tool arms for a full set of wrenches. However, multi-sized wrench heads are preferred in these examples because they provide greater functionality for nearly the same size wrench set, but using single size wrench heads is an option. Other embodiments can comprise additional hinges placed between the ends of the handles to provide additional folding of the wrench. Also many different shapes are possible for the arms and handles to provide various ergonomic advantages and the straight arm and handle shapes shown here are only examples that were easy to draw, but many more organic shapes (curved arms) can be easily adapted for use in a multitool. The reader should further understand that many other tools can be used with the disclosed folding multitool design than the hand tools presented here. For example, one tool arm could house a Swiss army knife like tool, with multiple fold out knives, screwdrivers, spoon, fork, etc. Almost any hand tool can be incorporated into the disclosed folding multitool. Finally, while many ergonomic examples have been shown here, these are only the personal preference of the Inventor, and many different ergonomic designs can be made, depending greatly on specific needs of the user. For example, for a carpenter, their personal preference might be a hammer that can easy to used in the multitool's stowed position, and only extended to a long handle position when needed. In this case, the carpenter may want multitool 120*d*, seen in FIG. 6A, but with the length of the tool arms on hammer 150 and wrench head 125 switched so that hammer 150 is extended past wrench head 125 when stowed and can more easily be used in a stowed position. For other people, significantly different configurations might be considered more useful or ergonomic.

Thus, instead of limiting the protection accorded by this document, or any document which is related to this document, to the material explicitly disclosed herein, the protection should be understood as being defined by the claims when the terms used in those claims which are set fourth below under the label "EXPLICIT DEFINITIONS" are given the explicit definitions set forth under that label, and the remaining terms are given their broadest reasonable interpretation as shown by a general purpose dictionary. To the extent that the interpretation which would be given based on the above disclosure or incorporated priority document is in any way narrower than the interpretation which would be given based on the "EXPLICIT DEFINITIONS" and the broadest reasonable interpretation as shown by a general purpose dictionary, the interpretation provided by the "EXPLICIT DEFINITIONS" and the broadest reasonable interpretation shall control, and the narrower interpretation shall have no effect.

Explicit Definitions

When used in the claims, "ROTATIONAL AXIS" and "PIVOTAL AXIS" should be understood to refer to the imaginary line through the axis of rotation of a hinge or rotatable structure. For wrench gripping surfaces the "rotational axis" should be understood to refer to the imaginary line through the center of the gripping surface substantially inline with the turning axis of a rotary fastener being turned by the gripping surface during use.

When used in the claims, "SUBSTANTIALLY PARALLEL" should be understood to refer to an angle within twenty degrees of being exactly parallel.

When used in the claims, "SUBSTANTIALLY PERPENDICULAR" should be understood to refer to an angle within twenty degrees of being exactly perpendicular.

When used in the claims, "LONGITUDINALLY ADJACENT" should be understood to refer to an arrangement of two or more elongated objects (e.g. tool arms, sockets, screwdrivers, etc.) which are brought lengthwise adjacent one another and their longitudinal axes are substantially parallel to a central axis (midpoint of the longitudinal axes) of the collection of elongated objects.

I claim:

1. A folding multitool for combining a plurality of different sized tools, comprising:

a) at least two, three, four, five, six, seven, and/or more elongated tool arms each with an inner end and an outer end, b) a first central hub defining at least two, three, four, five, and/or more folding hinges, wherein each folding hinge defines a pivotal axis, wherein at least one pivotal axis is oriented more than twenty degrees from being parallel with at least one other pivotal axis, wherein each elongated tool arm is pivotally attached to one folding hinge;

c) a center arm with an inner end and an outer end, wherein the inner end of the center arm is securely attached to the central hub so that it does not pivot with respect to the first central hub during use;

d) wherein a tool is mounted on the outer end of each elongated tool arm and/or center arm, wherein at least two of the tools each comprise a wrench head defining at least two wrench sizes, and e) wherein the folding multitool has an extended position comprising a first longitudinal length and a stowed position comprising a second longitudinal length, wherein the second longitudinal length is less than seventy percent, less than sixty-five percent, less than sixty percent, less than fifty-five percent, less than fifty percent, less than forty-five percent, and/or less than forty percent of the first longitudinal length.

2. The folding multitool in claim 1, wherein three, four, five, six, seven, eight and/or more of the tools on the elongated tool arms and/or center arm comprise a wrench head, wherein during use each wrench head defines at least two, three and/or more gripping surface with a rotational axis that is oriented substantially perpendicular to the pivotal axis of the folding hinge on which that wrench head's elongated tool arm is attached.

3. The folding multitool in claim 2, wherein at least one or more tools comprise an adjustable type wrench, a screwdriver, a hammer, ratchet wrench and/or a pliers.

4. The folding multitool in claim 2, wherein one or more of the tools comprise a hand tool other than a wrench.

5. The folding multitool in claim 1, wherein two or more of the tools comprise a hand tool other than a wrench.

6. The folding multitool in claim 1, wherein at least one tool comprises a screwdriver assembly comprising at least two, three and/or four separate screwdriver bit ends.

7. The folding multitool in claim 1, wherein at least two, three, four, five, six, and/or more tools comprise a duplex wrench head and/or overlapped wrench head for turning a plurality of different sized rotary fasteners.

8. The folding multitool in claim 1, further comprising a second central hub attached to the outer end of the central arm and defining one or more additional folding hinges, wherein each additional folding hinge defines a pivotal axis, wherein at least one pivotal axis on the second central hub is oriented more than twenty degrees from being parallel with at least one pivotal axis on the first central hub, wherein one or more of the elongated tool arms are pivotally mounted on the one or more of the additional folding hinges of the second central hub, whereby the folding multitool can tri-fold.

9. The folding multitool in claim 8, wherein the multitool can fold to a stowed position that has a maximum longitudinal length that is less than fifty percent, less than forty-five percent, and/or less than forty percent of its fully extended length.

10. The folding multitool in claim 9, wherein at least three of the tools comprise multiple sized wrenches and/or sockets.

11. The folding multitool in claim 1, wherein at least one pivotal axis is oriented substantially perpendicular to at least one other pivotal axis.

12. A folding multitool for combining a plurality of tools, comprising:

a) a central hub assembly comprising a first central hub, an elongated center arm and a second central hub, wherein the first and second central hubs are attached at a first and second ends of the elongated center arm, respectively, wherein the first central hub comprises at least two separate folding hinges with separate pivotal axes and the second central hub comprises at least one folding hinge;

b) at least three elongated tool arms each comprising a longitudinal axis, an inner end, and a tool head, wherein the inner end of each elongated tool arm is pivotally attached to one of the folding hinges;

c) wherein the folding multitool has a stowed position where the elongated tool arms are longitudinally adjacent and an extended position, wherein when in the extended position one or more of the elongated tool arms is used as a grip handle by the user, and d) wherein the maximum length of the folding multitool in the stowed position is less than fifty percent of the length of the folding multitool in the extended position.

13. The folding multitool in claim 12, wherein at least three tool heads each define at least two rotary fastener gripping surfaces for gripping and turning different sized rotary fasteners.

14. The folding multitool in claim 13, wherein each of the at least two rotary fastener gripping surfaces defines one or more rotational axes that are substantially perpendicular to the pivotal axis of the folding hinge to which each particular tool head's elongated tool arm is attached.

15. The folding multitool in claim 12, wherein at least one folding hinge defined on the second central hub defines a pivotal axis that is oriented more than twenty degrees from parallel with a second pivotal axis defined by at least one folding hinge on the first central hub.

16. The folding multitool in claim 15, wherein at least three tool heads each define two different sized rotary fastener gripping surfaces, wherein rotary fastener gripping surfaces define a rotational axis that is substantially perpendicular to a pivotal axis defined by the folding hinge to which that tool head's elongated tool arm is attached.

17. The folding multitool in claim 12, wherein at least one tool head is an adjustable type wrench head, screwdriver bit, ratchet wrench head, hammer, and/or pliers.

18. The folding multitool in claim 12, wherein at least two, three, four, five, six, and/or more tool heads comprise a duplex and/or overlapped wrench heads for turning the plurality of different sized rotary fasteners.

* * * * *